US007438053B2

(12) United States Patent
Serizawa

(10) Patent No.: US 7,438,053 B2
(45) Date of Patent: Oct. 21, 2008

(54) FUEL DELIVERY PIPE

(75) Inventor: Yoshiyuki Serizawa, Susono (JP)

(73) Assignee: Usui Kokusai Sangyo Kaisha, Ltd., Shizuoka-ken (JP)

( * ) Notice: Subject to any disclaimer, the term of this patent is extended or adjusted under 35 U.S.C. 154(b) by 0 days.

(21) Appl. No.: 11/338,294

(22) Filed: Jan. 24, 2006

(65) Prior Publication Data

US 2006/0162698 A1 Jul. 27, 2006

(30) Foreign Application Priority Data

Jan. 24, 2005 (JP) ..... 2005-015226
Feb. 24, 2005 (JP) ..... 2005-049601

(51) Int. Cl.
*F02M 41/00* (2006.01)

(52) U.S. Cl. ..... 123/467; 123/456

(58) Field of Classification Search ..... 123/467, 123/468, 469, 470, 514, 456
See application file for complete search history.

(56) References Cited

U.S. PATENT DOCUMENTS

| | | | | |
|---|---|---|---|---|
| 3,507,263 | A * | 4/1970 | Long | 123/455 |
| 5,752,486 | A * | 5/1998 | Nakashima et al. | 123/467 |
| 5,782,222 | A * | 7/1998 | Morris et al. | 123/456 |
| 6,354,273 | B1 * | 3/2002 | Imura et al. | 123/467 |
| 6,431,149 | B1 * | 8/2002 | Schwegler et al. | 123/467 |
| 6,672,286 | B2 * | 1/2004 | Miandoab et al. | 123/456 |
| 6,761,150 | B2 * | 7/2004 | Zdroik | 123/456 |
| 6,935,314 | B2 * | 8/2005 | Zdroik et al. | 123/456 |
| 7,093,584 | B1 * | 8/2006 | Potter et al. | 123/447 |
| 7,185,636 | B2 * | 3/2007 | Usui et al. | 123/467 |
| 7,228,846 | B2 * | 6/2007 | Kilgore | 123/447 |

FOREIGN PATENT DOCUMENTS

| | | |
|---|---|---|
| JP | 8-193553 | 7/1996 |
| JP | 2000-240530 | 9/2000 |
| JP | 2000-329030 | 11/2000 |
| JP | 2000-329031 | 11/2000 |
| JP | 2003-343377 | 12/2003 |
| JP | 2004-28076 | 1/2004 |
| JP | 2004-132231 | 4/2004 |
| JP | 2004-137977 | 5/2004 |

(Continued)

*Primary Examiner*—Carl S Miller
(74) *Attorney, Agent, or Firm*—Jordan and Hamburg LLP

(57) ABSTRACT

A purpose of the present invention is to provide a fuel delivery pipe having a flexible absorb wall surface formed on a wall surface thereof in which a fuel introduction pipe is connected to an interior of the fuel delivery pipe body at one end thereof in a longitudinal direction in order to achieve a suppression of a transfer of a first mode of a standing wave and a second mode of the standing wave and an enhanced placement layout and inexpensive cost.

The fuel delivery pipe includes the flexible absorb wall surface formed on the wall surface thereof and injection nozzles, in which fuel introduction pipe 10 is connected to one end of fuel delivery pipe body 1 of a returnless type without a circuit returning to a fuel tank and is coupled with the fuel tank through an underfloor pipe arrangement. In the fuel delivery pipe, provided that an entire length of an interior of fuel delivery pipe body 1 in the longitudinal direction is 100, fuel introduction pipe 10 is inserted into fuel delivery pipe body 1 up to a position between 15 and 35 or a position between 65 and 85 with regard to the entire length and then securely connected to fuel delivery pipe body 1.

10 Claims, 20 Drawing Sheets

FOREIGN PATENT DOCUMENTS

| | | |
|---|---|---|
| JP | 2005-90423 | 4/2005 |
| JP | 2005-98287 | 4/2005 |
| JP | 2005-127195 | 5/2005 |
| WO | WO- 03/008796 | 1/2003 |
| WO | WO- 03/016706 | 2/2003 |
| WO | WO- 2004/033894 | 4/2004 |

* cited by examiner

FUEL DELIVERY PIPE

BACKGROUND OF THE INVENTION

The present invention is directed to a fuel delivery pipe which is used in an electronic fuel injection type automotive engine and which includes an absorb wall surface formed on a wall. A purpose of the fuel delivery pipe is to reduce vibration and noise due to a fuel pressure pulsation induced by a fuel injection.

Conventionally, a fuel delivery pipe for feeding fuel such as gasoline or the like to a plural cylinders of an engine by means of a plural injection nozzles. In this type of fuel delivery pipe, fuel introduced from a fuel tank through an underfloor pipe arrangement is sequentially injected from the plural injection nozzles into a plural air intake pipes or cylinders to mix the fuel with air and thus mixed air-fuel mixture is burned to generate an output of the engine.

This fuel delivery pipe to be often used includes a return type having a circuit to return an excessive fuel to the fuel tank by using a pressure regulator and a returnless type without the circuit to return the excessive fuel to the fuel tank, when the excessive fuel is fed from the fuel tank. Recently, the returnless type fuel delivery pipe is more employed for the purposes of reducing a cost and avoiding a temperature rise of the gasoline in the fuel tank and the like.

In this returnless type fuel delivery pipe, since there is no pipe arrangement for returning the excessive fuel to the fuel tank, when the fuel injection from the injection nozzles to the air intake pipes or cylinders depressurizes an interior pressure of the fuel delivery pipe, this sudden depressurizing and a stop of the fuel injection causes a pressure wave that is transferred to the fuel tank from the fuel delivery pipe and a connection pipe connected to the fuel delivery pipe to be inverted such that the pressure wave is returned from a pressure controlling valve within the fuel tank to be transferred to the fuel delivery pipe through the connection pipe. The fuel delivery pipe is provided with the plural injection nozzles for injecting fuel sequentially, which causes the pressure pulsation. As such, the pressure pulsation is transferred to an interior of a car through clips for securing the underfloor pipe arrangement. This noise brings a discomfort to a driver and fellow passengers.

To suppress a problem due to the pressure pulsation as stated above, conventionally employed as disclosed in Japanese Patent Laying-Open No. 2000-329030 is such a method that the fuel delivery pipe is formed with a flexible absorb wall surface on a wall surface for absorbing and reducing the fuel pressure pulsation induced by the fuel injection such that the absorb surface is flexed and deformed by receiving a pressure caused by the fuel injection. With such a method, low-frequency component equal to or less than several tens of Hz of the fuel pressure pulsation can be suppressed.

However, a formation of the flexible absorb wall surface on the wall surface of the fuel delivery pipe as stated above allows a standing wave caused within a body of the fuel delivery pipe transfers from a high-frequency area to a low-frequency area, resulting in that the standing wave transfering to the low-frequency area causes new vibration and noise. Specifically, as shown in Japanese Patent Laying-Open No. 08-193553 and FIG. 30, fuel introduction pipe 52 is conventionally securely connected to one end of fuel delivery pipe body 51 to arrange opening 53 of fuel introduction pipe 52 at one end of an interior of fuel delivery pipe body 51. Therefore, as shown in FIG. 31, opening 53 of fuel introduction pipe 52 is arranged in the vicinity of an antinode where the standing wave caused within fuel delivery pipe body 51 becomes to be a maximum amplitude, thereby raising a problem that the pulsation transfer becomes large due to a first mode of the standing wave as illustrated by a solid line in FIG. 31 and a second mode of the standing wave as illustrated by a dashed line also in FIG. 31.

To resolve the above problem, such a method as shown in Japanese Patent Laying-Open No. 2000-329030 and FIG. 32 is known to public that fuel introduction pipe 52 is arranged to be connected with fuel delivery pipe body 51 vertically in order to arrange opening 53 of fuel introduction pipe 52 in the vicinity of a center within fuel delivery pipe body 51. With such a method, fuel delivery pipe body 51 and fuel introduction pipe 52 are connected to each other in such a manner as shown in FIG. 33 that opening 53 of fuel introduction pipe 52 is arranged in the vicinity of a node of the first mode of the standing wave to suppress the transfer of the first mode of the standing wave, thereby being capable of suppressing vibration and noise of a car.

However, if fuel introduction pipe 52 is connected to fuel delivery pipe body 51 vertically in such a manner as disclosed in Japanese Patent Laying-Open No. 2000-329030 and FIG. 32, there arise problems such as an interference with other automotive parts and shortage of clearances, resulting in a drawback of an awful layout.

To resolve such problems, there are disclosed the fuel delivery pipes which can resolve the problems of the interference with other automotive parts and shortage of clearances and achieve a good layout, respectively, by FIG. 4 of Japanese Patent Laying-Open No. 2000-329030 in which the fuel introduction pipe is inserted from one end of the fuel delivery pipe in a longitudinal direction to arrange the opening of the fuel introduction pipe in the vicinity of a center of the fuel delivery pipe and by Japanese Patent Laying-Open No. 2000-329031 in which the opening of the fuel introduction pipe is inserted vertically to the fuel delivery pipe to be arranged therein and the fuel introduction pipe is designed into L-shape to arrange the underfloor fuel introduction pipe arrangement in parallel with the fuel delivery pipe.

However, since the opening of the fuel introduction pipe according to each of FIG. 4 of Japanese Patent Laying-Open No. 2000-329030 and Japanese Patent Laying-Open No. 2000-329031 is positioned in the vicinity of the node of the first mode of the standing wave, it is possible to suppress the transfer of the fist mode of the standing wave as stated above, whereas since the opening of the fuel introduction pipe, at the same time, is positioned in the vicinity of the antinode of the second mode of the standing wave, the pulsation transfer of the second mode of the standing wave becomes large to have raised problems of vibration and noise at around 1 kHz induced by the second mode of the standing wave. Alike what is disclosed in Japanese Patent Laying-Open No. 2000-329031, if the fuel introduction pipe is bent into L-shape in order to improve a placement layout, a L-shaped joint is required for connecting with the fuel introduction pipe, resulting in a drawback of increasing a manufacturing cost.

BRIEF SUMMARY OF THE INVENTION

The present invention is directed to resolve the problems as stated above and therefore attempts to obtain such a fuel delivery pipe body formed with the flexible absorb wall surface on the wall surface that the fuel introduction pipe is connected to one end of the fuel delivery pipe body in the longitudinal direction to achieve suppression of the transfer of the both of the first mode of the standing wave and the second mode of the standing wave, an improved placement layout and low manufacturing cost.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF THE INVENTION

Figure 1:
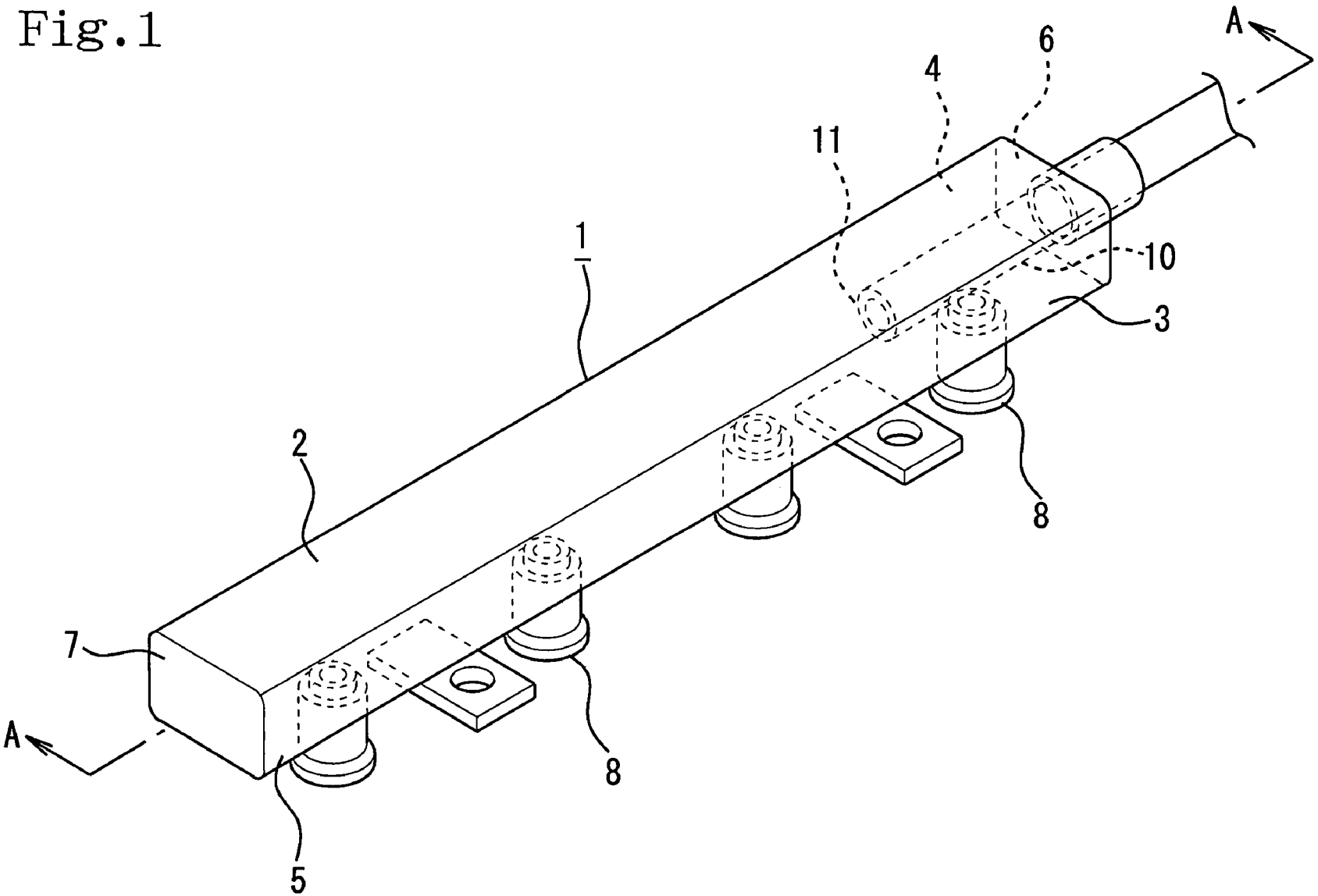
FIG. 1 is a perspective view illustrating the first embodiment according to the first invention and the second invention of the fuel delivery pipe of the present application.

To resolve the above stated problems, a first invention is a fuel delivery pipe having a flexible absorb wall formed on a wall surface and a holder into which injection nozzles are inserted, with one end of the fuel delivery pipe body of a returnless type without a circuit to return to a fuel tank receiving a fuel introduction pipe for a connection, the fuel introduction pipe is coupled to the fuel tank through an underfloor pipe arrangement, in which, provided that an entire length in an longitudinal direction of an interior of the fuel delivery pipe body is 100, the fuel introduction pipe is inserted into the fuel delivery pipe body at a position between 15% and 35% with regard to the entire length and securely connected to the fuel delivery pipe.

Further, a second invention is a fuel delivery pipe having a flexible absorb wall formed on a wall surface and a holder into which injection nozzles are inserted, with one end of the fuel delivery pipe body of a returnless type without a circuit to return to a fuel tank receiving a fuel introduction pipe for a connection, the fuel introduction pipe is connected to the fuel tank through an underfloor pipe arrangement, in which, provided that an entire length in an longitudinal direction of an interior of the fuel delivery pipe body is 100%, the fuel introduction pipe is inserted into the fuel delivery pipe body at a position between 20% and 30% with regard to the entire length and securely connected to the fuel delivery pipe.

Further, a third invention is a fuel delivery pipe having a flexible absorb wall formed on a wall surface and a holder into which injection nozzles are inserted, with one end of the fuel delivery pipe body of a returnless type without a circuit to return to a fuel tank receiving a fuel introduction pipe for a connection, the fuel introduction pipe is connected to the fuel tank through an underfloor pipe arrangement, in which, provided that an entire length in an longitudinal direction of an interior of the fuel delivery pipe body is 100%, the fuel introduction pipe is inserted into the fuel delivery pipe body at a position between 65% and 85% with regard to the entire length and securely connected to the fuel delivery pipe.

Still further, a fourth invention is a fuel delivery pipe having a flexible absorb wall formed on a wall surface and a holder into which injection nozzles are inserted, with one end of the fuel delivery pipe body of a returnless type without a circuit to return to a fuel tank receiving a fuel introduction pipe for a connection, the fuel introduction pipe is connected to the fuel tank through an underfloor pipe arrangement, in which, provided that an entire length in an longitudinal direction of an interior of the fuel delivery pipe body is 100%, the fuel introduction pipe is inserted into the fuel delivery pipe body at a position between 70% and 80% with regard to the entire length and securely connected to the fuel delivery pipe.

The fuel introduction pipe may be secured at an end wall of the fuel delivery pipe body.

The fuel introduction pipe may be so structured that an outer peripheral surface of an insertion section inserted and arranged within the fuel delivery pipe body is directly secured to an interior surface of the fuel delivery pipe body.

The direct securing of an outer peripheral surface of the front end of the fuel introduction pipe into the fuel delivery pipe body may be so structured that a curved section is provided with the insertion section of the fuel introduction pipe inserted and arranged within the fuel delivery pipe body and a front end of the curved section is secured to the interior surface of the fuel delivery pipe body.

The direct securing of the outer peripheral surface of the front end of the fuel introduction pipe into the fuel delivery pipe body may be so structured that a diameter of the front end of the insertion section of the fuel introduction pipe inserted and arranged within the fuel delivery pipe body is expanded and an outer peripheral surface of the expanded diameter section is secured to the interior surface of the fuel delivery pipe body.

The direct securing of the outer peripheral surface of the front end of the fuel introduction pipe into the fuel delivery pipe body may be so structured that the front end of the insertion section of the fuel delivery pipe inserted and arranged within the fuel delivery pipe body is projected in a direction of the interior surface of the fuel delivery pipe body to form an projecting section and an outer peripheral surface of this projection is secured to the interior surface of the fuel delivery pipe body.

The fuel introduction pipe may be so structured that on the outer peripheral surface of the front end of the outer peripheral surface of the insertion section inserted and arranged within the fuel delivery pipe body is provided with a connecting member through which the fuel introduction pipe is secured to the interior surface of the fuel delivery pipe body.

The fuel introduction pipe may be so structured that at least a pair of cutting portions in an axis direction of the front end, these cutting portions are curved toward the fuel delivery pipe body and these curved sections are secured to the interior surface of the fuel delivery pipe body.

The present invention is a fuel delivery pipe structured as stated above of a returnless type without a circuit to return to the fuel tank, the fuel delivery pipe enabling to suppress the low-frequency component of the fuel pressure pulsation caused upon the fuel injection by forming the flexible absorb wall surface on the wall surface, in which the placement layout of the fuel delivery pipe is enhanced and the manufacturing cost thereof can be reduced as well, by inserting and arranging the fuel introduction pipe into the fuel delivery pipe from the one end in the longitudinal direction.

Adjusting an insertion length of the fuel introduction pipe, a position of the opening of the fuel introduction pipe within the fuel delivery pipe body is held away from the anitnodes of both of the first mode of the standing wave and the second mode of the standing wave induced within the fuel delivery pipe body. As such, transfers of both of the fuel pressure pulsation of several hundreds Hz due to the first mode of the standing wave and the fuel pressure pulsation of around 1 kHz due to the second mode of the standing wave are suppressed to achieve reduction of vibration and noise of component members of the car.

According to the first invention, provided that the entire length of the interior of the fuel delivery pipe body in the longitudinal direction is 100%, the fuel introduction pipe is inserted to the position between 15% and 35% with regard to the entire length within the fuel delivery pipe body. If the insertion length is shortened than the position of 15%, a position of the opening of the fuel introduction pipe comes to close to the antinode of the first mode of the standing wave and the second mode of the standing mode and therefore the pulsation transfer due to the both first and the second modes of the standing wave becomes large, whereas if the insertion length is elongated than the position of 35%, a position of the opening of the fuel introduction pipe comes to close to the antinode of the second mode of the standing wave, and therefore the pulsation transfer due to the second mode becomes large.

According to the second invention, provided that the entire length of the interior of the fuel delivery pipe body in the longitudinal direction is 100%, the fuel introduction pipe is inserted to the position between 20% and 30% within the fuel delivery pipe body with regard to the entire length. Within the aforementioned range, the opening of the fuel introduction pipe is held away from the antinode of the first mode of the standing wave and is held away from the antinode of the second mode of the standing wave as well, such that the pulsation transfer caused due to both of the first mode of the standing wave and the second mode of the standing wave can be suppressed.

According to the third invention, provided that the entire length of the interior of the fuel delivery body is 100%, the fuel introduction pipe is inserted to the position between 65% and 85% within the fuel delivery pipe body with regard to the entire length. If the insertion length is shortened than the position of 65%, a position of the opening of the fuel introduction pipe comes to close to the antinode of the second mode of the standing wave, and therefore the pulsation transfer due to the second mode of the standing wave becomes large, whereas if the insertion length is elongated than the position of 85%, a position of the opening of the fuel introduction pipe comes to the antinode of the first mode of the standing wave and the antinode of the second mode of the standing wave, such that the pulsation transfer caused due to both of the first mode of the standing wave and the second mode of the standing wave becomes large.

According to the fourth invention, provided that the entire length of the interior of the fuel delivery body in the longitudinal direction is 100%, the fuel introduction pipe is inserted to the position between 70% and 80% within the fuel delivery pipe body with regard to the entire length. Within the aforementioned range, the opening of the fuel introduction pipe is held away from the antinode of the first mode of the standing wave and is held away from the antinode of the second mode of the standing wave as well, such that the pulsation transfer caused due to both of the first mode of the standing wave and the second mode of the standing wave can be suppressed.

A first embodiment of a heat exchange pipe according to the present invention is explained into details referring to FIG. 1. 1 denotes the fuel delivery pipe body having a cross sectional shape, vertical to the pipe axis direction, of a compressed rectangular shape. Fuel delivery pipe body 1 is composed of top wall 2 and bottom wall 3 arranged in the pipe axis direction, a pair of side walls 4, 5 for coupling top wall 2 and bottom wall 3 together and a pair of end walls 6, 7 to be arranged at both ends of the fuel delivery pipe in the pipe axis direction. An entire length of each of top wall 2 and bottom wall 3 in the longitudinal direction is 320 mm and a length of each of top wall 2 and bottom wall 3 in the width direction is 34 mm.

A height of each of side walls 4, 5 is 10.2 mm and a thickness of each of top wall 2, bottom wall 3 and both side walls 4, 5 of fuel delivery pipe body 1 is 1.2 mm. Securely connected onto bottom wall 3 is a plural sockets 8 which enables a connection of the injection nozzles (not shown) for injecting fuel into air intake paths or cylinders of the engine. Top wall 2 and bottom wall 3 of fuel delivery pipe body 1 are formed of the absorb wall surfaces flexible and deformable upon receiving pressure caused by injection of fuel from the injection nozzles. Upon providing such absorb surfaces, low-frequency component of the fuel pressure pulsation caused by the fuel injection can be suppressed.

Figure 2:
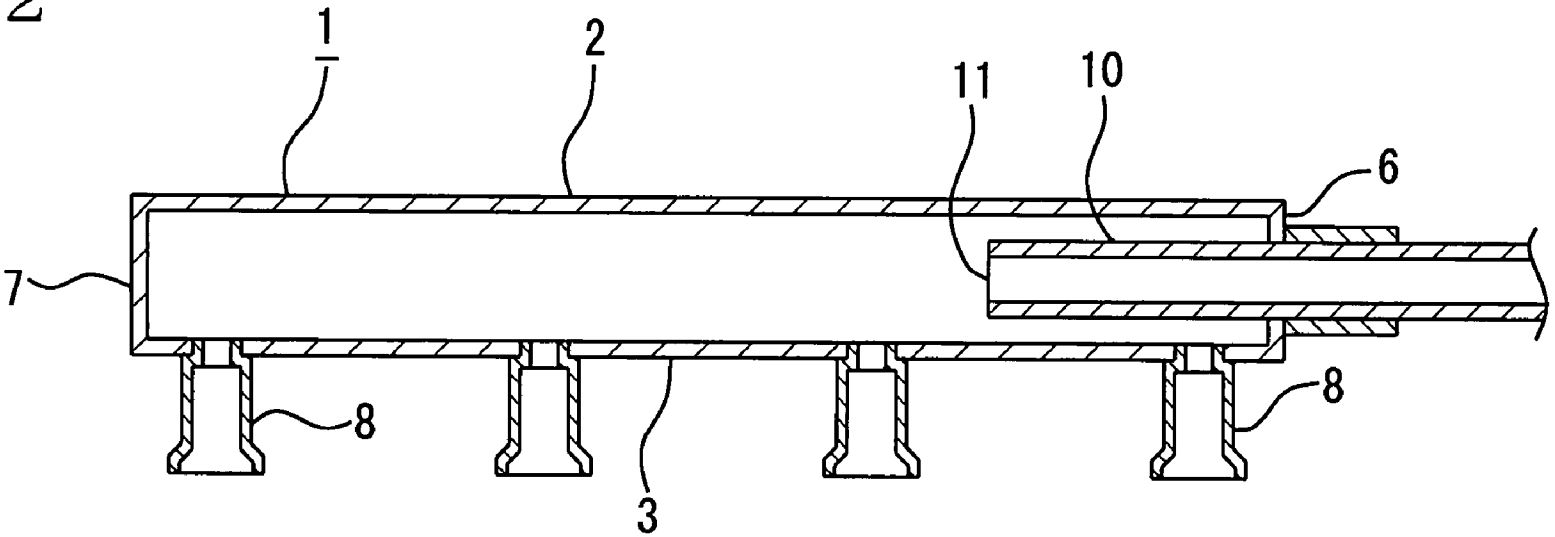
FIG. 2 is a cross sectional view taken along the line A-A of FIG. 1.
Figure 3:
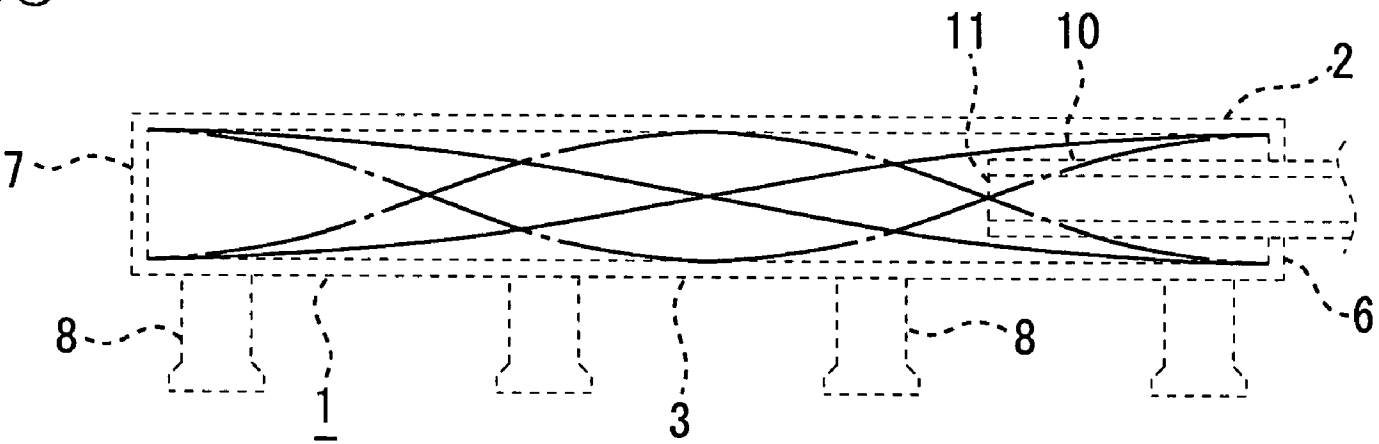
FIG. 3 is a schematic diagram of the first mode of the standing wave and the second mode of the standing wave occurring within the first embodiment of the fuel delivery pipe.

Fuel introduction pipe 10 is inserted into and arranged within fuel delivery pipe body 1 through one of end wall 6. As shown in FIG. 2, provided that the entire length of the interior of fuel delivery pipe body 1 is 100%, fuel introduction pipe 10 is inserted to a length position of about 25% within fuel delivery pipe body 1 and is secured at end wall 6 of fuel delivery pipe body 1. By inserting, arranging and connecting fuel introduction pipe 10 within fuel longitudinal direction, placement layout of the fuel delivery pipe can be improved and the manufacturing cost can be reduced as well since other special parts are not required. Fuel introduction pipe 10 is coupled to the fuel tank through the underfloor pipe arrangement.

Figure 4:
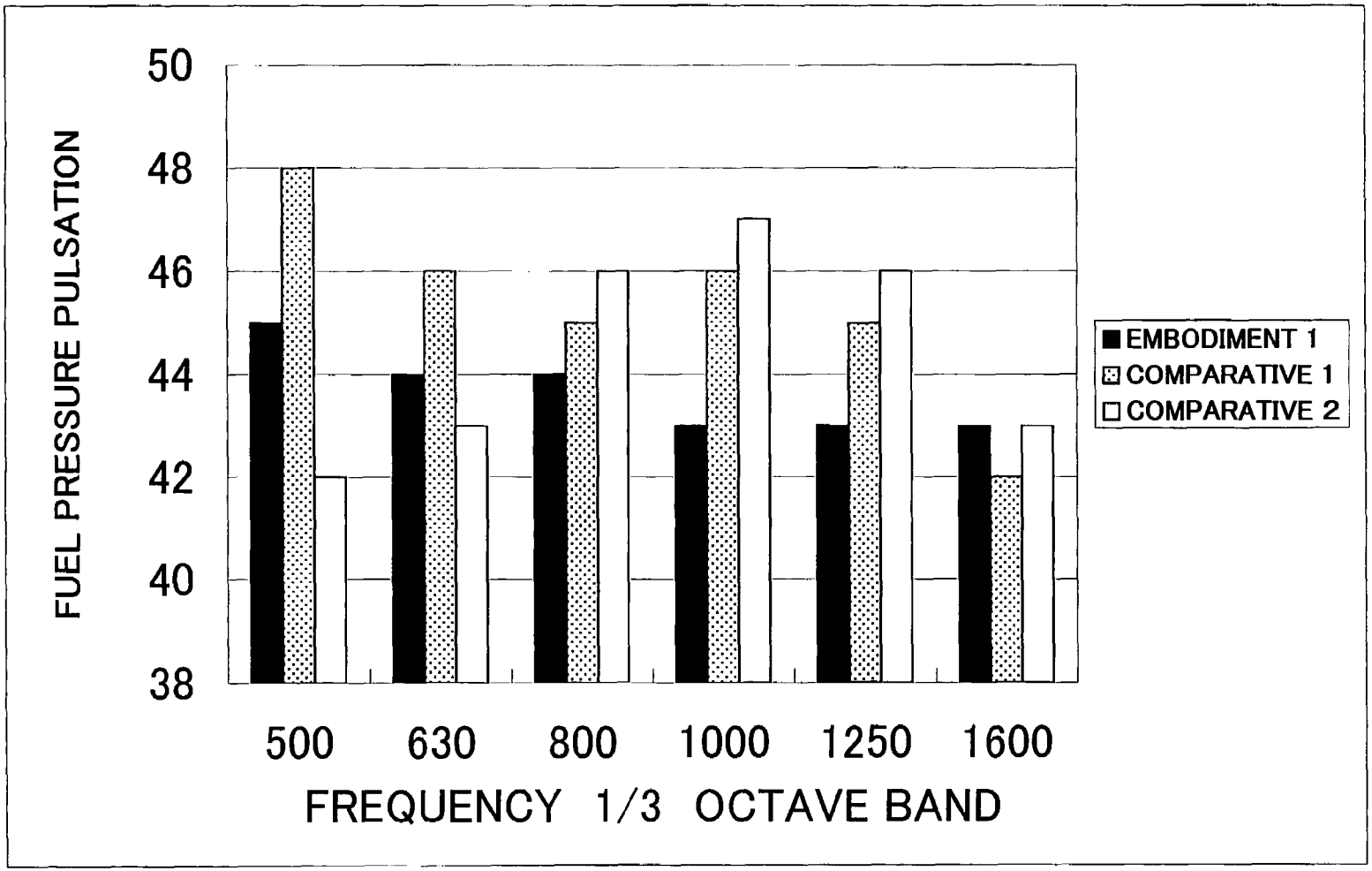
FIG. 4 is a bar graph indicating a measurement result of the fuel pressure pulsation in each frequency.
Figure 30:
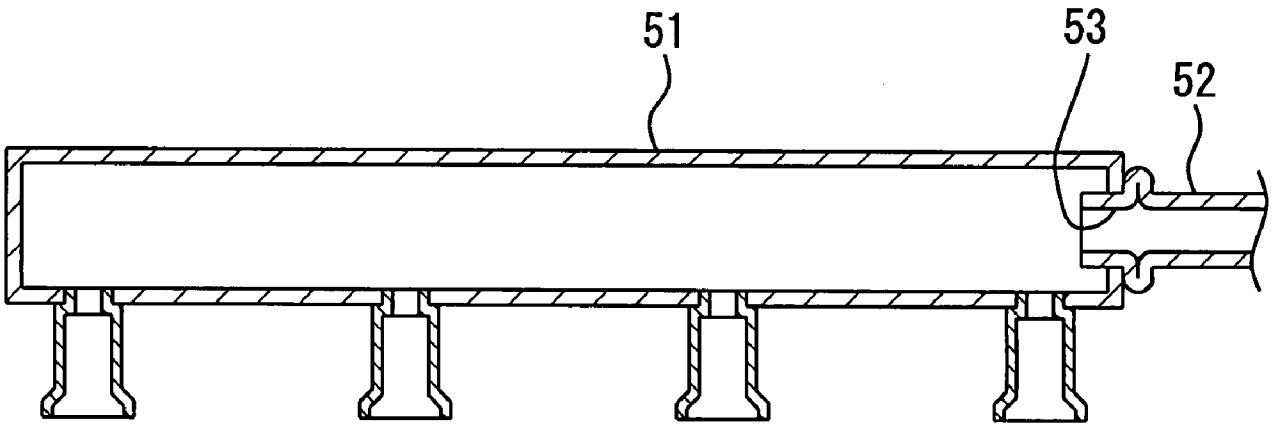
FIG. 30 is a cross sectional view of the fuel delivery pipe according to the conventional art.
Figure 32:
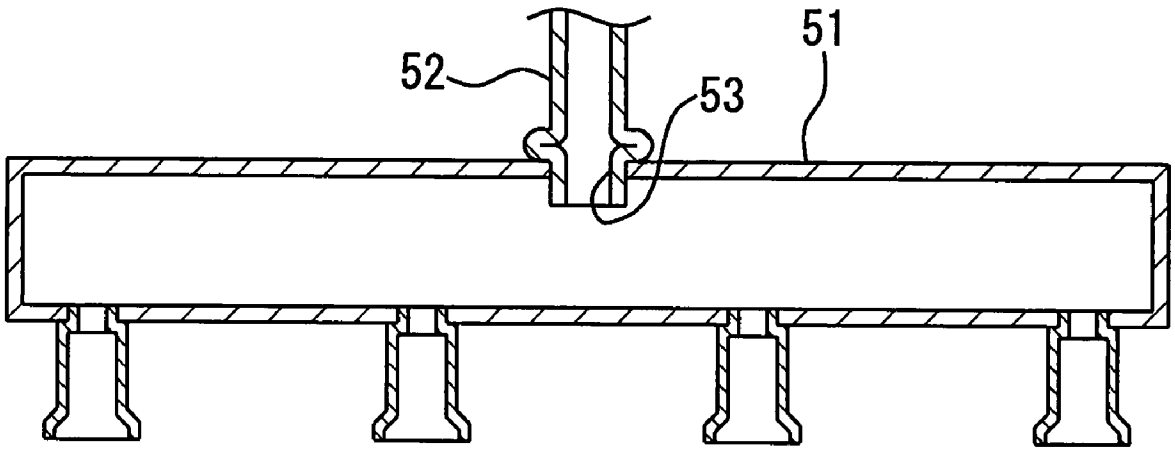
FIG. 32 is a cross sectional view of the fuel delivery pipe according to the conventional art.

Regarding fuel delivery pipe body 1 having the above stated structure, FIG. 4 shows a result of measurement of a magnitude of the fuel pressure pulsation of each frequency caused within fuel delivery pipe body 1. The measurement was performed with regard to fuel delivery pipe body 51, shown in FIG. 30, as a first comparative of the first embodiment in which opening 53 of fuel introduction pipe 52 is arranged at the end of the interior of fuel delivery pipe body 51, and fuel delivery pipe body 51, shown in FIG. 32, as a second comparative of the first embodiment in which opening 53 of fuel introduction pipe 52 is arranged in the vicinity of a center of the interior of fuel delivery pipe body 51, respectively. Fuel delivery pipe body 51 and fuel introduction pipe 52 used in the first and second comparatives each has the same shape and the same size as fuel delivery pipe body 1 and fuel introduction pipe 10 according to the present invention as used in the first embodiment.

Figure 31:
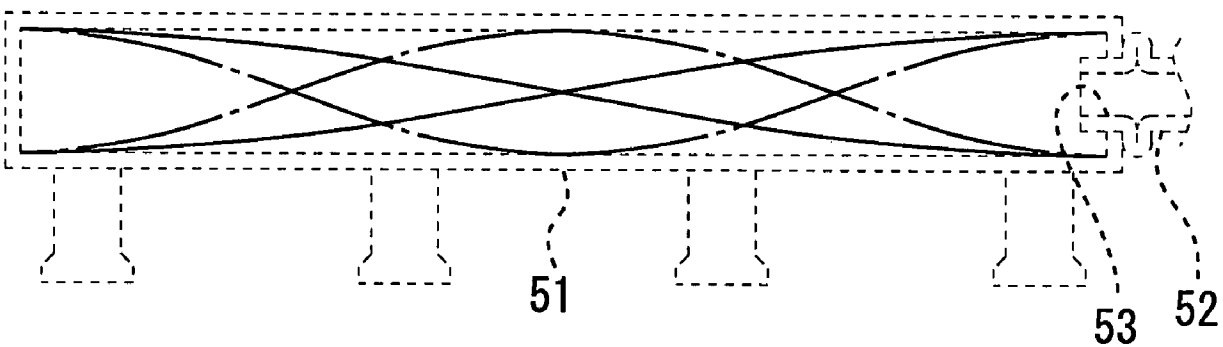
FIG. 31 is a schematic diagram of the first mode of the standing wave and the second mode of the standing wave occurring within the fuel delivery pipe according to the conventional art.
Figure 33:
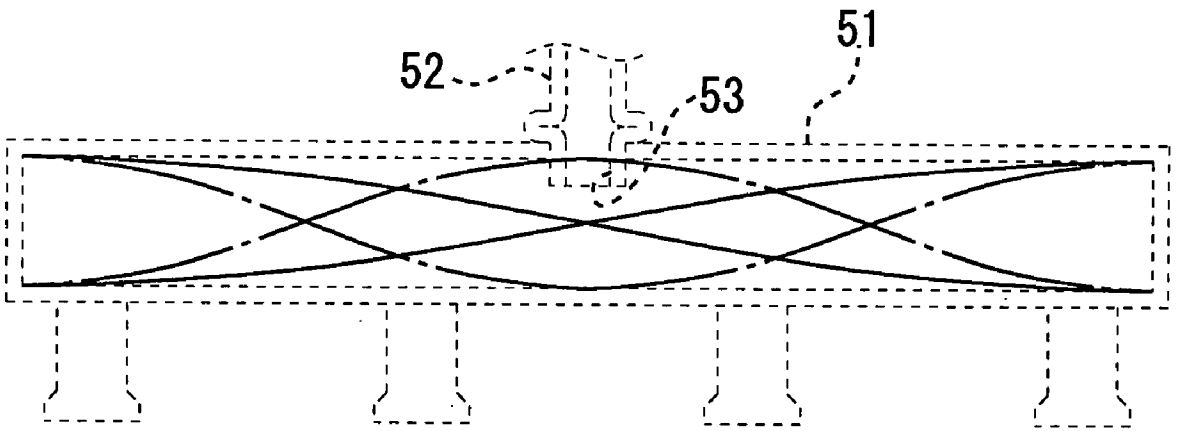
FIG. 33 is a schematic view of the first mode of the standing wave and the second mode of the standing mode occurring within the fuel delivery pipe according to the conventional art.

As a result, since the first comparative has opening 53 of fuel introduction pipe 52 in the vicinity of an antinode of the first mode of the standing wave and the second mode of the standing wave as shown in FIG. 31, high values are observed at 500 Hz and 1 kHz induced due to both of the first mode of the standing wave and the second mode of the standing wave, and since the second comparative has opening 53 of fuel introduction pipe 52 in the vicinity of antinode of the second mode of the standing wave as shown in FIG. 33, a high value is observed at 1 kHz induced due to the second mode of the standing wave. On the other hand, in the present first embodiment, since opening 11 of fuel introduction pipe 10 is arranged between the antinode and node of the first mode of the standing wave and is arranged in the vicinity of the node of the second mode of the second standing wave as well, relatively low values are observed both at 500 kHz due to the first mode of the standing wave and at 1 kHz due to the second mode of the standing wave.

In view of the above stated result, it is confirmed that suppression of the fuel pressure pulsation due to the first mode of the standing wave and the second mode of the standing wave is hard to achieve in the first comparative and suppression of the fuel pressure pulsation due to the second mode of the standing wave is also hard to achieve in the second comparative, whereas the fuel delivery pipe according to the present first embodiment can suppress the fuel pressure pulsation due to the first mode of the standing wave and can also suppress a transfer of the fuel pressure pulsation due to the second mode of the standing wave.

Figure 9:
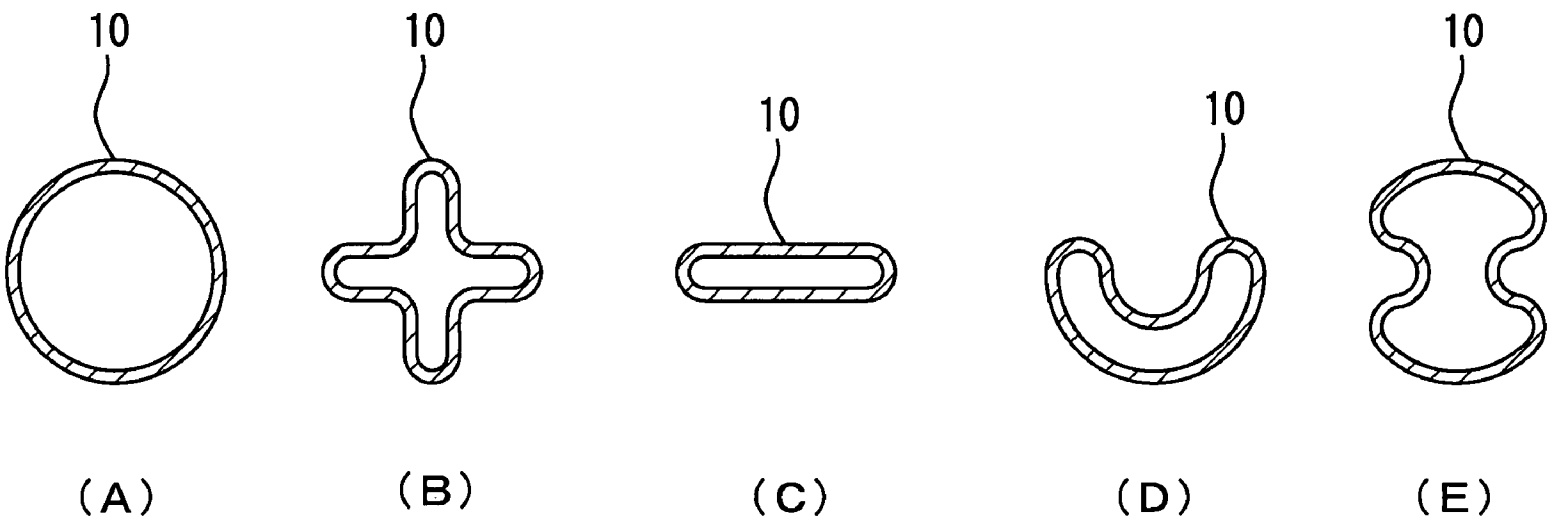
FIG. 9 is a cross sectional view of the fuel introduction pipe to be used in the first to third embodiments and the other embodiments of the present invention.

In the present embodiment and the above stated first embodiment and the second embodiment, a cross sectional shape of fuel introduction pipe 10 is formed into a circular shape as shown in FIG. 9A; however, in the other embodiment, considering cases where a height of the fuel delivery pipe is low and where clearances from walls are hard to obtain, the cross sectional shape may be formed into a cross shape, depressed shape, U-shape or 8-shape as shown in FIGS. 9B, 9C, 9D and 9E in order to form with ease when fuel introduction pipe 10 to be inserted into fuel delivery pipe body 1 is subjected to drawing.

Figure 5:
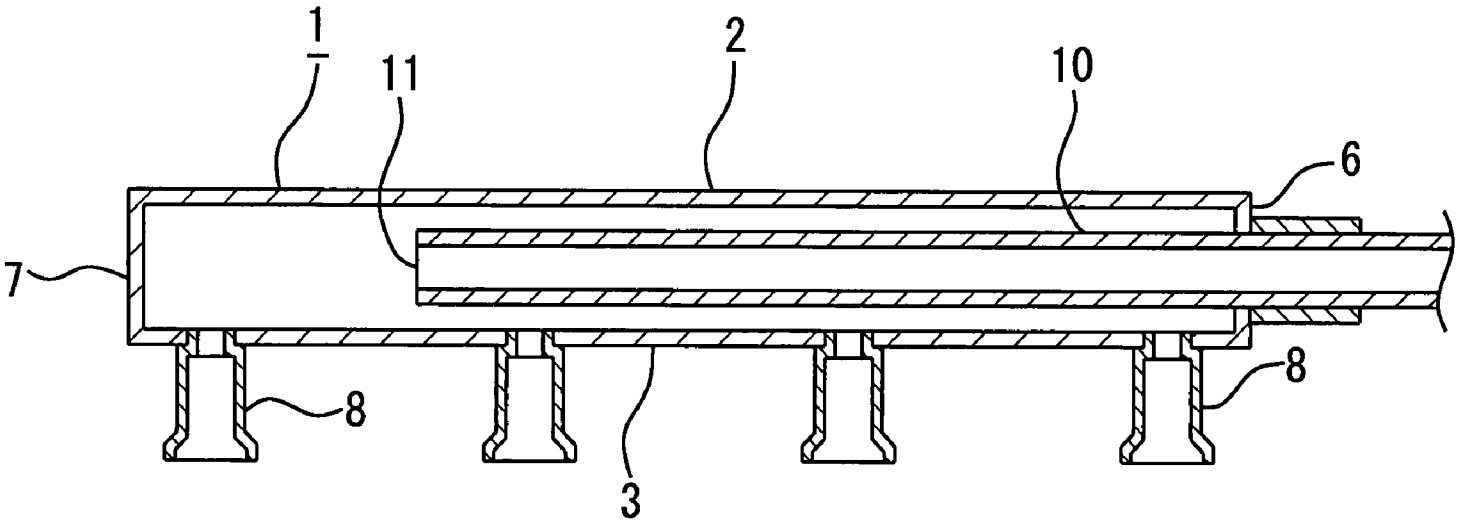
FIG. 5 is a cross sectional view of the fuel delivery pipe illustrating the second embodiment according to the third invention and the fourth invention of the present application.
Figure 6:
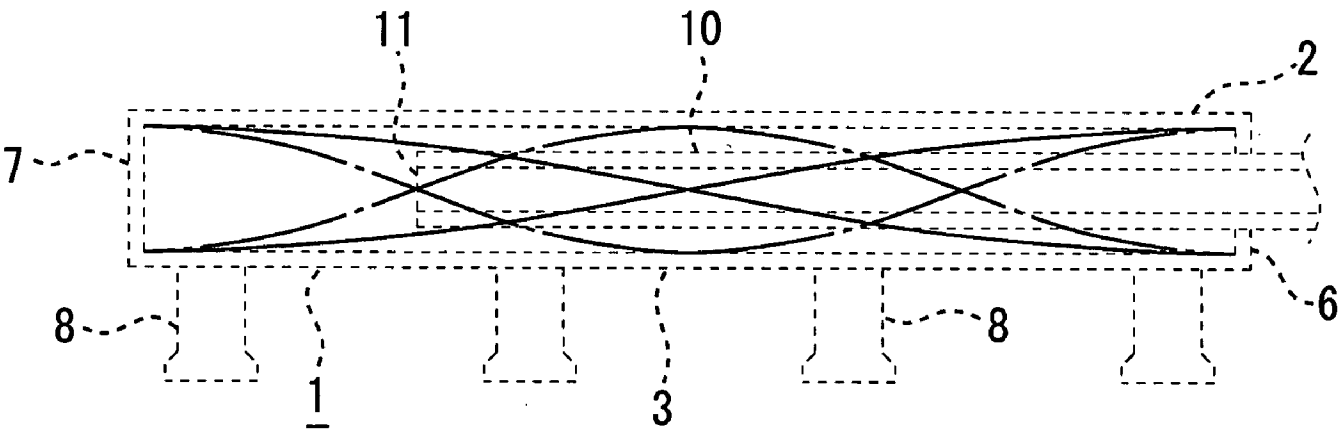
FIG. 6 is a schematic diagram of the first mode of the standing wave and the second mode of the standing wave occurring within the fuel delivery pipe according to the second embodiment.
Figure 7:
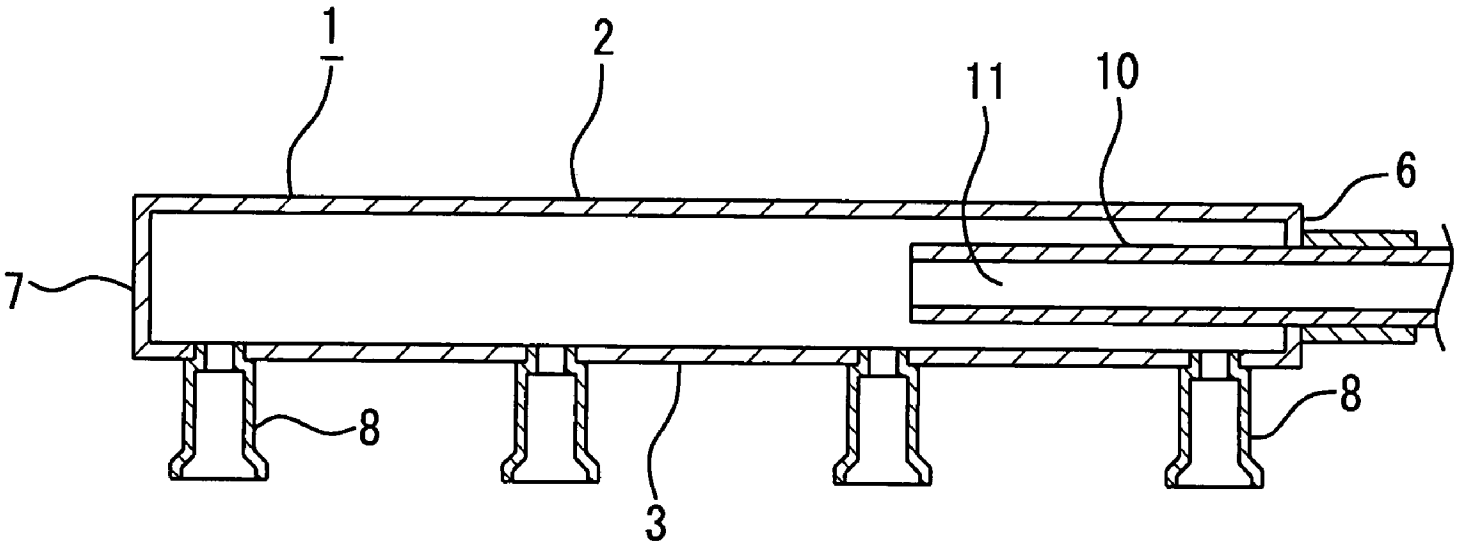
FIG. 7 is a cross sectional view of the fuel delivery pipe illustrating the third embodiment according to the first invention of the present application.

In the above first embodiment, providing that the entire length of the interior of fuel delivery pipe body 1 in the longitudinal direction is 100, fuel introduction pipe 10 is inserted and arranged at a length position of 25 within fuel delivery pipe body 1 to connect the fuel introduction pipe with fuel delivery pipe body 1, whereas in the second embodiment, fuel introduction pipe 10 is inserted and arranged at a length position of 75 within fuel delivery pipe body 1 as shown in FIG. 5.

The insertion and arrangement of fuel introduction pipe 10 to such a length position within fuel delivery pipe body 1 enables an arrangement of opening 11 of fuel introduction pipe 10 in the vicinity of a middle of the antinode and node of the first mode of the standing wave and an arrangement of the opening of the fuel introduction pipe in the vicinity of the node of the second mode of the standing wave caused within fuel delivery pipe body 1, and thus both of the transfer of the fuel pressure pulsation due to the first mode of the standing wave and the transfer of the fuel pressure pulsation due to the second mode of the standing wave can be suppressed.

Further in the above first embodiment and the second embodiment, providing that the entire length of the interior of fuel delivery pipe body 1 in the longitudinal direction is 100, fuel introduction pipe 10 is inserted and arranged at the length position of 25 and 75 in the respective embodiment to connect the fuel introduction pipe with fuel delivery pipe body 1, whereas in a third embodiment, fuel introduction pipe 10 is inserted and arranged at the length position of 33 within fuel delivery pipe body 1.

Figure 8:
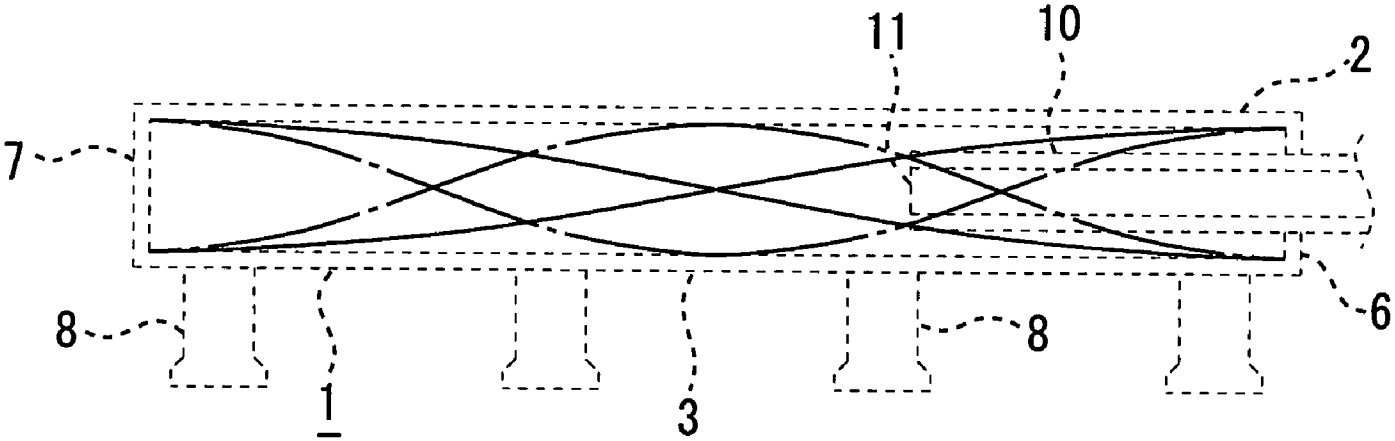
FIG. 8 is a schematic view of the first mode of the standing wave and the second mode of the standing view occurring within the fuel delivery pipe according to the third embodiment.

Opening 11 of fuel introduction pipe 10 is held away from the antinode of the first mode of the standing wave and simultaneously away from the antinode of the second mode of the standing wave as shown in FIG. 8, with the fuel introduction pipe 10 being inserted and arranged within fuel delivery pipe body 1, and therefore it becomes possible to suppress both of the fuel pressure pulsation due to the first mode of the standing wave and the fuel pressure pulsation due to the second mode of the outstanding wave at the same time. The arrangement of fuel introduction pipe 10 at such a position allows opening 11 of fuel introduction pipe 10 to be arranged at the node of the first mode of the standing wave where the vibration and noise are especially apt to be a problem, and therefore the fuel pressure pulsation due to the first mode of the standing wave can be suppressed, resulting in an effective reduction of the vibration and noise in the car.

In the above embodiment 1 to 3, fuel introduction pipe 10 is secured only at end wall 6 of fuel delivery pipe body 1, whereas in a fourth embodiment, fuel introduction pipe 10 is secured at end wall 6 of fuel delivery pipe body 1 and the front end of insertion section 12 of fuel introduction pipe 10 inserted and arranged within fuel delivery pipe body 1 is secured to an interior surface of fuel delivery pipe body 1 as well.

Figure 10:
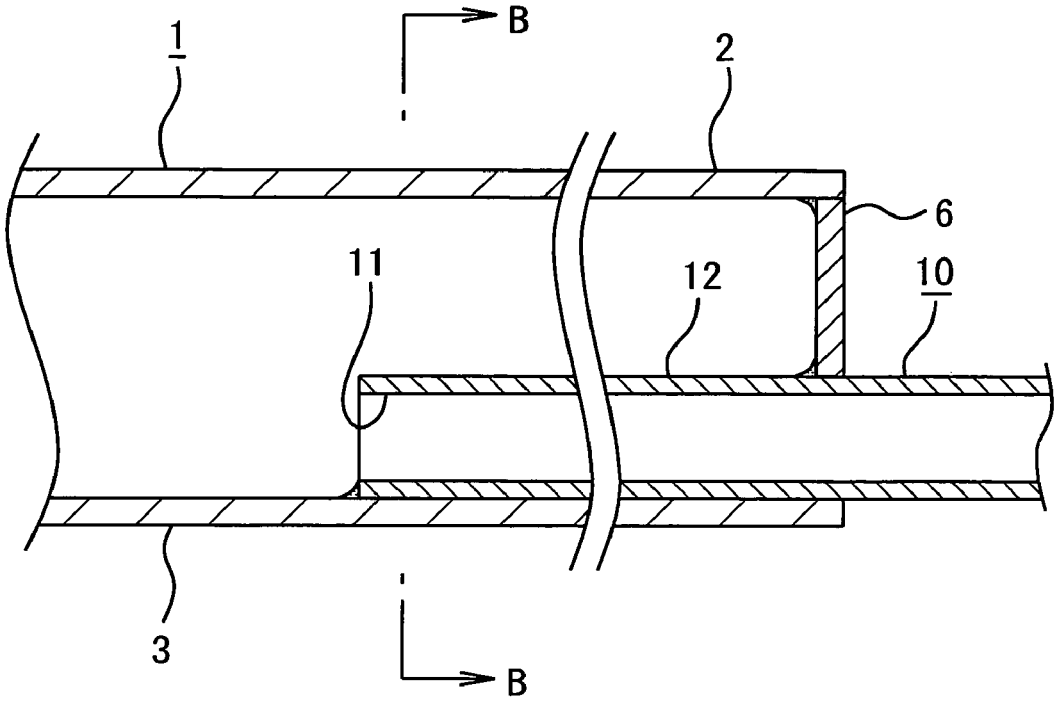
FIG. 10 is a cross sectional view of the fuel delivery pipe illustrating the fourth embodiment according to the first to fourth inventions of the present application.
Figure 11:
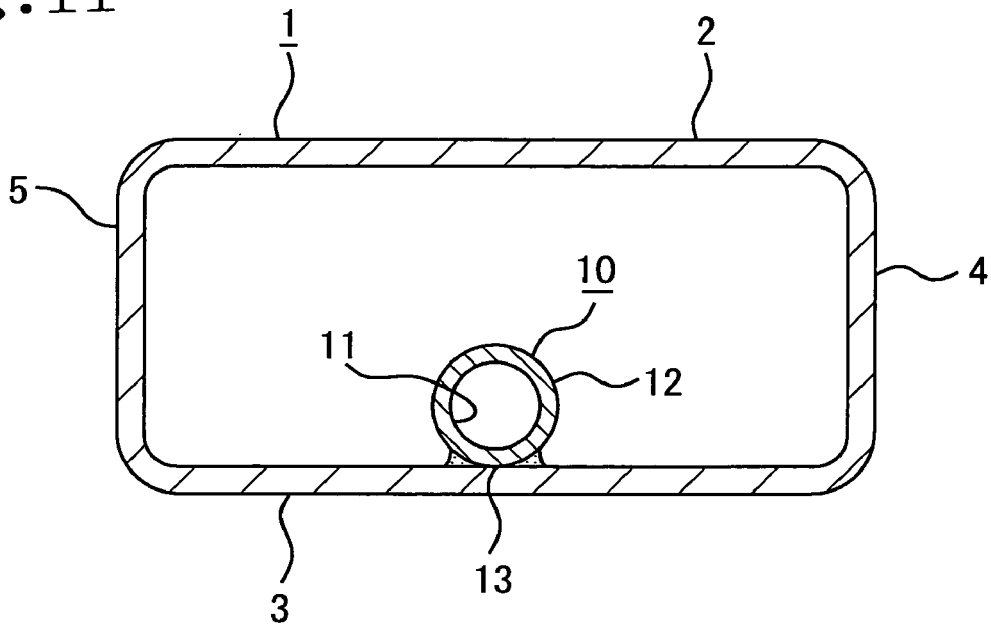
FIG. 11 is a cross sectional view taking along the line B-B of FIG. 10.

Explanation is given to the fourth embodiment referring to FIGS. 10 and 11. Fuel introduction pipe 10 is inserted and arranged at a center within fuel delivery pipe body 1 in the width direction, with the entire length of the outer peripheral surface of insertion section 12 being in contact with the interior surface of bottom surface 3 of fuel delivery pipe body 1. Then, contact section 13 between the outer peripheral surface of fuel introduction pipe 10 and the interior surface of fuel delivery pipe body 1 is subjected to a brazing as shown in FIG. 11 to secure insertion section 12 of fuel delivery pipe 10 within fuel delivery pipe body 1.

As stated above, since securing of insertion section 12 of fuel introduction pipe 10 within fuel delivery pipe body 1 achieves to suppress the vibration of insertion section 12 of fuel introduction pipe 10, thereby being capable of avoiding a breakage of fuel introduction pipe 10 that may occur in the vicinity of securing section with end wall 6.

Figure 12:
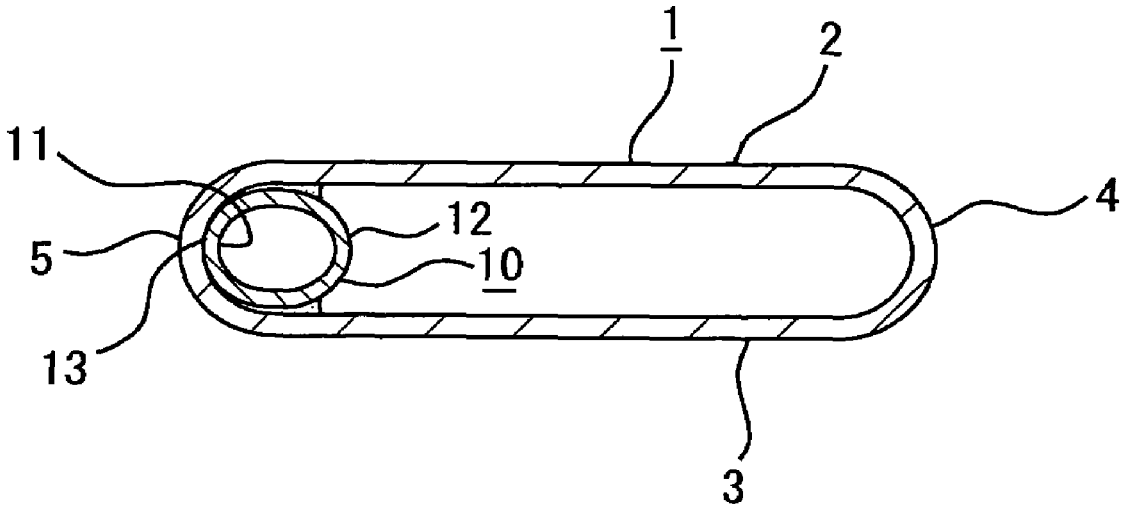
FIG. 12 is a cross sectional view of the fuel delivery pipe illustrating the fifth embodiment according to the first to fourth embodiments of the present application.

In the above first to fourth embodiments and the following sixth to fifteenth embodiments, the cross sectional shape vertical to the pipe axis direction of fuel delivery pipe body 1 is formed into a compressed rectangular shape, whereas in a fifth embodiment as shown in FIG. 12, the cross sectional shape is formed into a compressed oblong shape, with top wall 2 and bottom wall 3 formed of the absorb wall surfaces. In the above first to fourth embodiments and the following sixth to fifteenth embodiments, the cross sectional shape vertical to the axis direction of fuel introduction pipe 10 is formed into the circular shape, whereas in the fifth embodiment, the cross sectional shape is formed into a compressed oval shape.

In the above fourth embodiment, fuel introduction pipe 10 is arranged at a center of the interior surface of bottom wall 3, formed of the absorb wall surface, of fuel delivery pipe body 1, whereas in the fifth embodiment as shown in FIG. 12, fuel introduction pipe 10 is not arranged on the absorb wall surface but is secured and arranged on the interior surface of side wall 5 of fuel delivery pipe body 1 by means of brazing. As stated above, by arranging fuel introduction pipe 10 not on the absorb wall surface but on the interior surface of side wall 5 of fuel delivery pipe body 1, the flexibility of the absorb wall surface can sufficiently work without inhibitions, thereby being able to enhance a suppressing effect of the low-frequency component of the fuel pressure pulsation.

Figure 13:
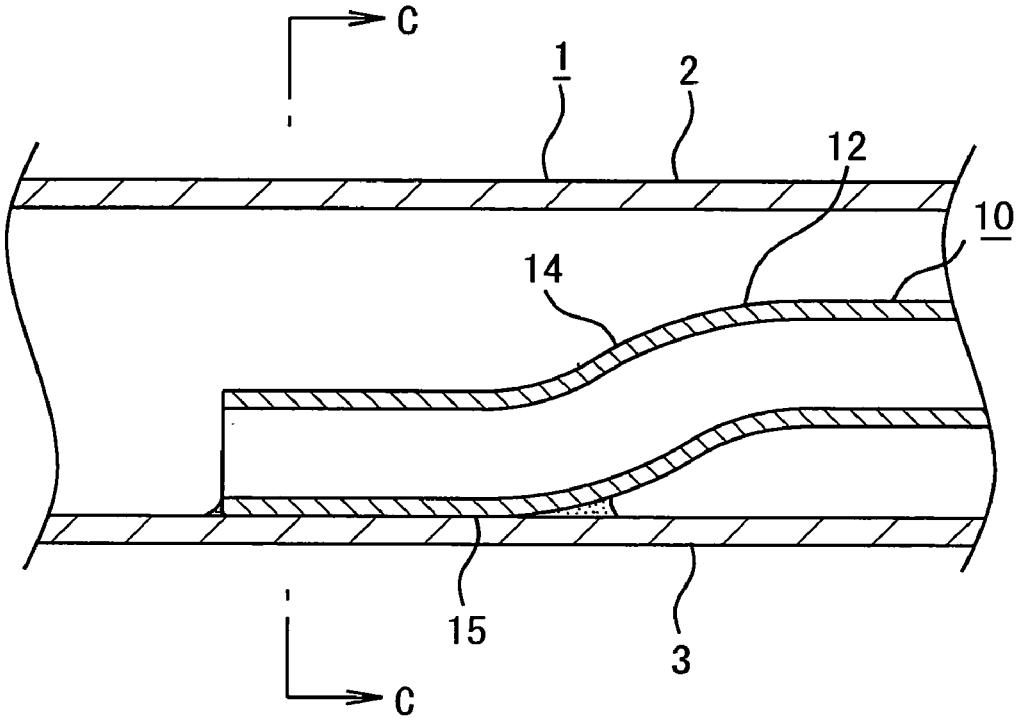
FIG. 13 is a cross sectional view of the fuel delivery pipe illustrating the sixth embodiment according to the first to fourth inventions of the present application.
Figure 14:
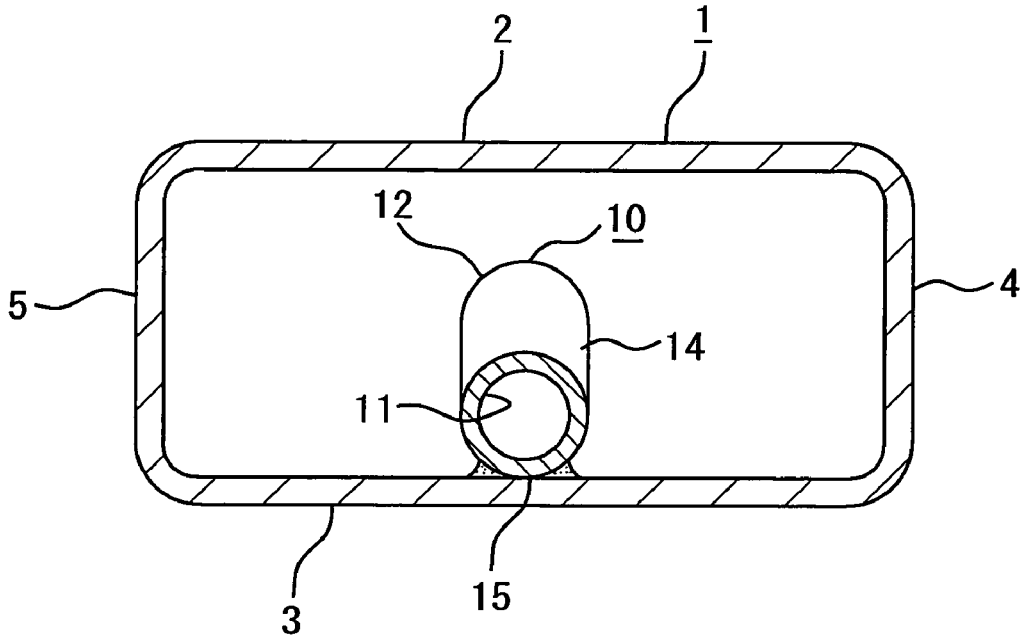
FIG. 14 is a cross sectional view taking along the line C-C of FIG. 13.

In the above fourth embodiment, entire length of the outer peripheral surface of insertion section 12 of fuel introduction pipe 10 is directly brought into contact with the interior surface of bottom wall 3 of fuel delivery pipe body 1 to secure fuel introduction pipe 10 to fuel delivery pipe body 1, whereas in the sixth embodiment, fuel introduction pipe 10 is inserted and arranged at about a center within fuel delivery pipe body 1 in the height direction and insertion section 12 of fuel introduction pipe 10 is curved in a direction of the interior surface of bottom wall 3 of fuel delivery pipe body 1 to form curved section 14 and the outer peripheral surface of the front end of curved section 14 is brought into contact with the interior surface of bottom wall 3 of fuel delivery pipe body 1 and contact section 15 is brazed on the interior surface of bottom wall 3 as well as illustrated in FIGS. 13 and 14.

Figure 15:
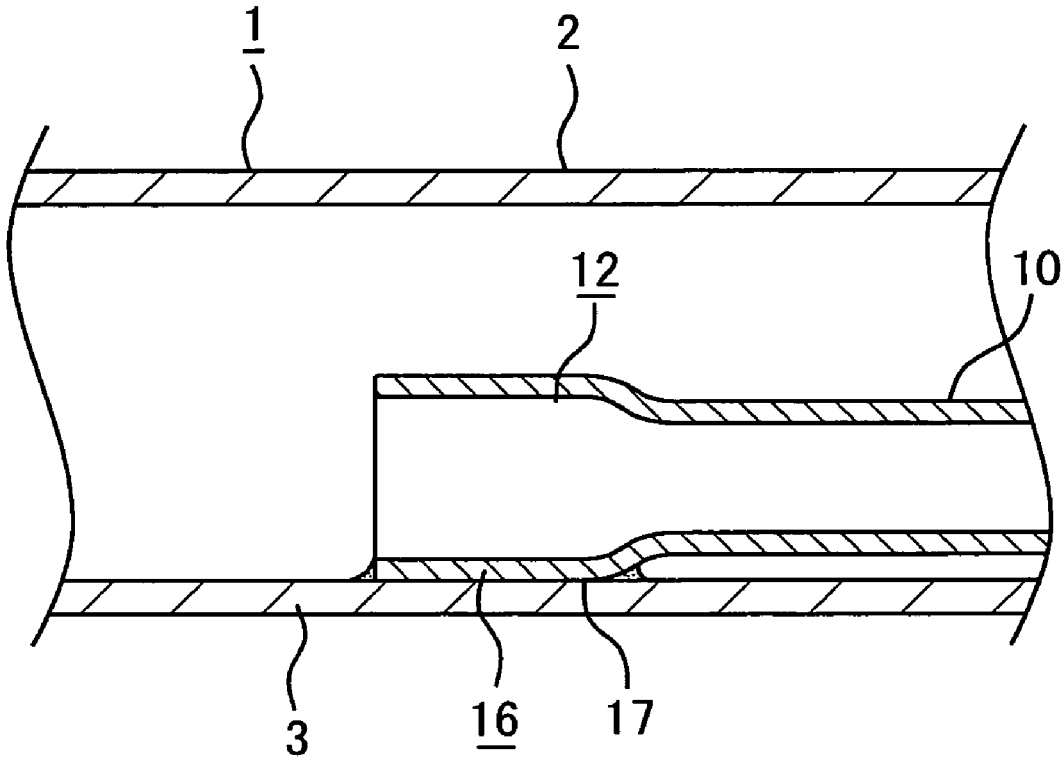
FIG. 15 is a cross sectional view of the fuel delivery pipe illustrating the seventh embodiment according to the first to fourth embodiments of the present application.

In the seventh embodiment as shown in FIG. 15, the front end of insertion section 12 of fuel introduction pipe 10 is expanded of its diameter toward the interior surface of bottom wall 3 of fuel delivery pipe body 1 to form expanded diameter section 16 and an outer peripheral surface of expanded diameter section 16 is brought into contact with the interior surface of bottom wall 3 of fuel delivery pipe body 11 to secure the resulting contact section 17 by means of brazing.

Figure 16:
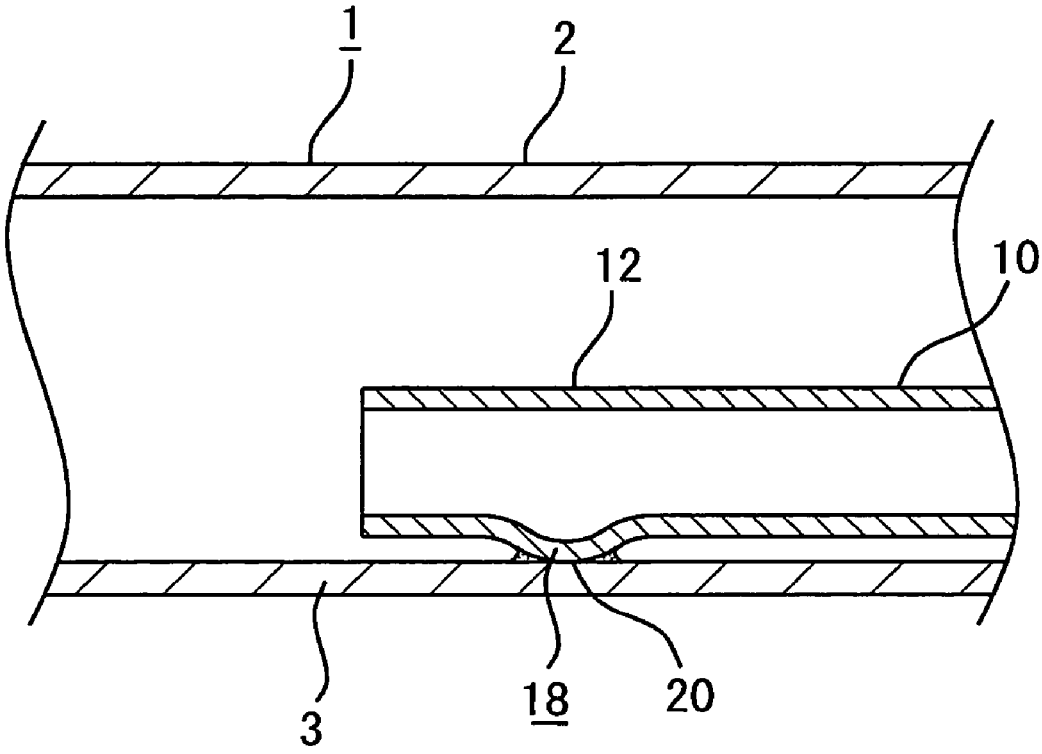
FIG. 16 is a cross sectional view of the fuel delivery pipe illustrating the eighth embodiment according to the first to fourth inventions of the present application.

In an eighth embodiment as shown in FIG. 16, the front end of insertion section 12 of fuel introduction pipe 10 is formed with projection 18 projecting in a direction of interior surface of bottom wall 3 of fuel delivery pipe body 1, and the outer peripheral surface of projection 18 is brought into contact with the interior surface of bottom wall 3 of fuel delivery pipe body 1 to secure thus made contact section 20 by means of brazing.

As shown in the present eighth embodiment and the fourth to seventh embodiments, direct securing of the front end of insertion section 12 of fuel introduction pipe 10 to the interior surface of fuel delivery pipe body 1 enables to suppress the vibration of insertion section 12 of fuel introduction pipe 10, and therefore the breakage of fuel introduction pipe 10 at around the securing section with end wall 6 due to the vibration or the like of the car and engine can be avoided without requiring extra parts and with a low cost.

In the above fourth to eighth embodiments, insertion section 12 or the front end of insertion section 12 of fuel introduction pipe 10 is directly secured to the interior surface of fuel delivery pipe body 1, whereas in the ninth embodiment, connection member 21 is provided with the outer peripheral surface of insertion section 12 such that insertion section 12 of fuel introduction pipe 10 is secured to the interior surface of fuel delivery pipe body 1 through connection member 21.

Figure 17:
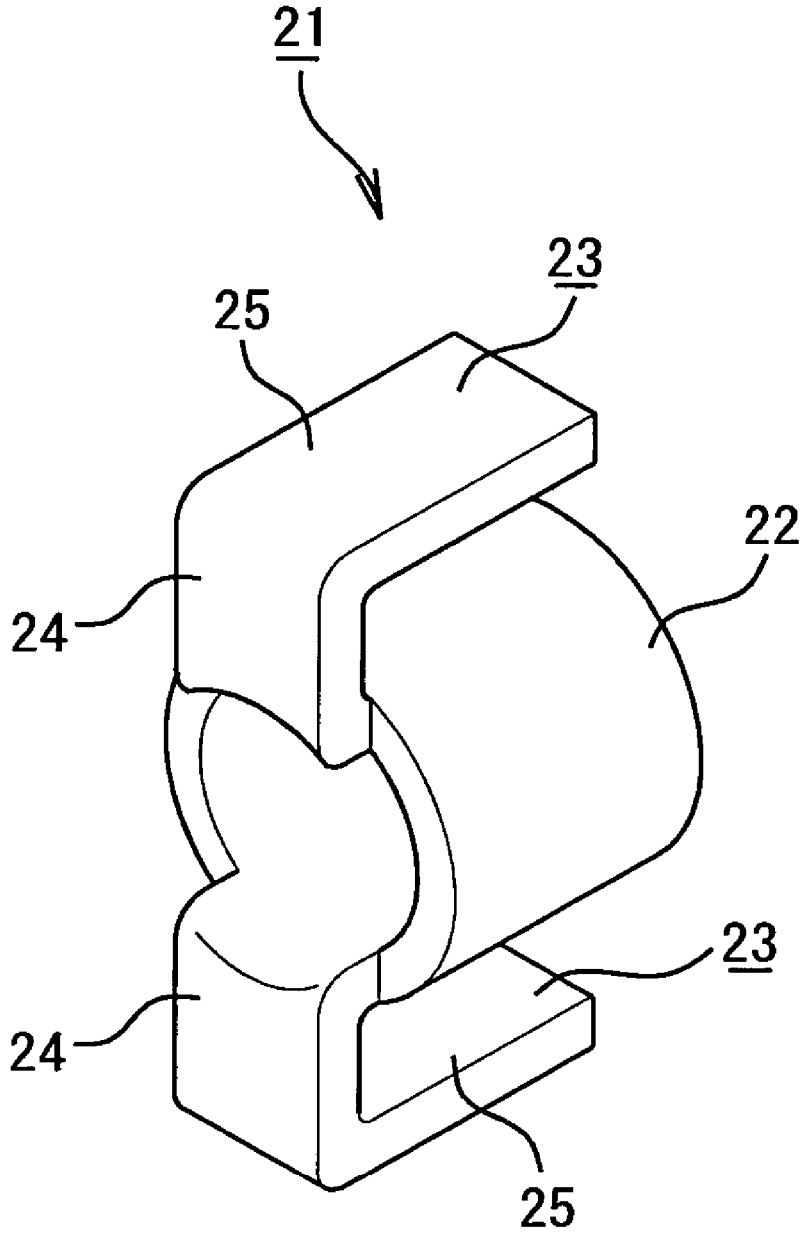
FIG. 17 is a perspective view of the connecting member of the ninth embodiment according to the first to fourth inventions of the present application.
Figure 18:
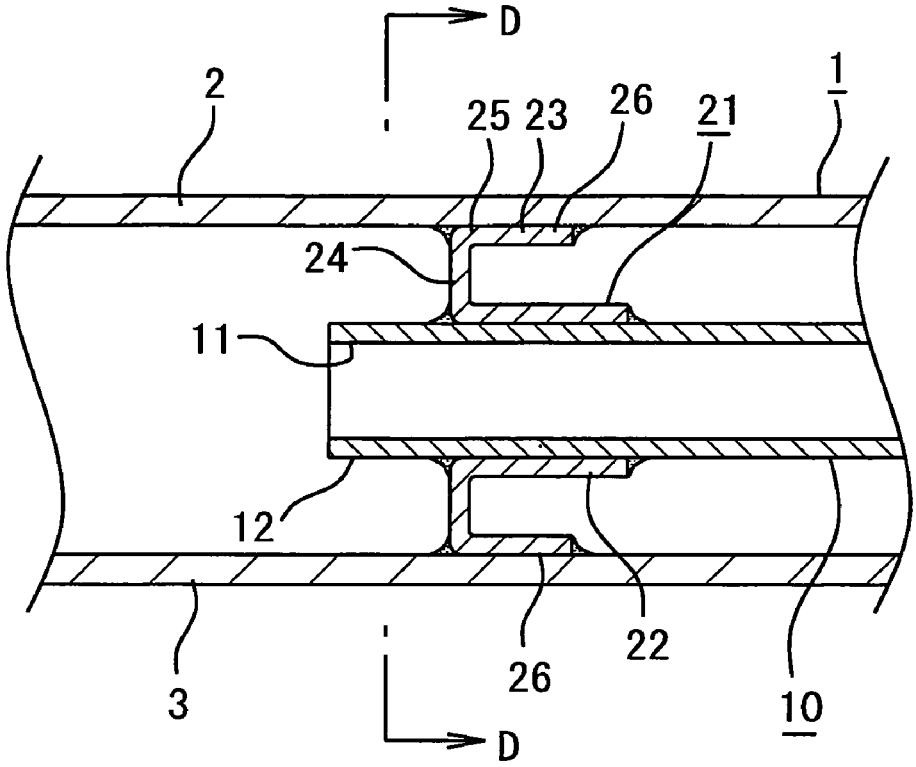
FIG. 18 is a cross sectional view of the fuel delivery pipe illustrating the ninth embodiment.
Figure 19:
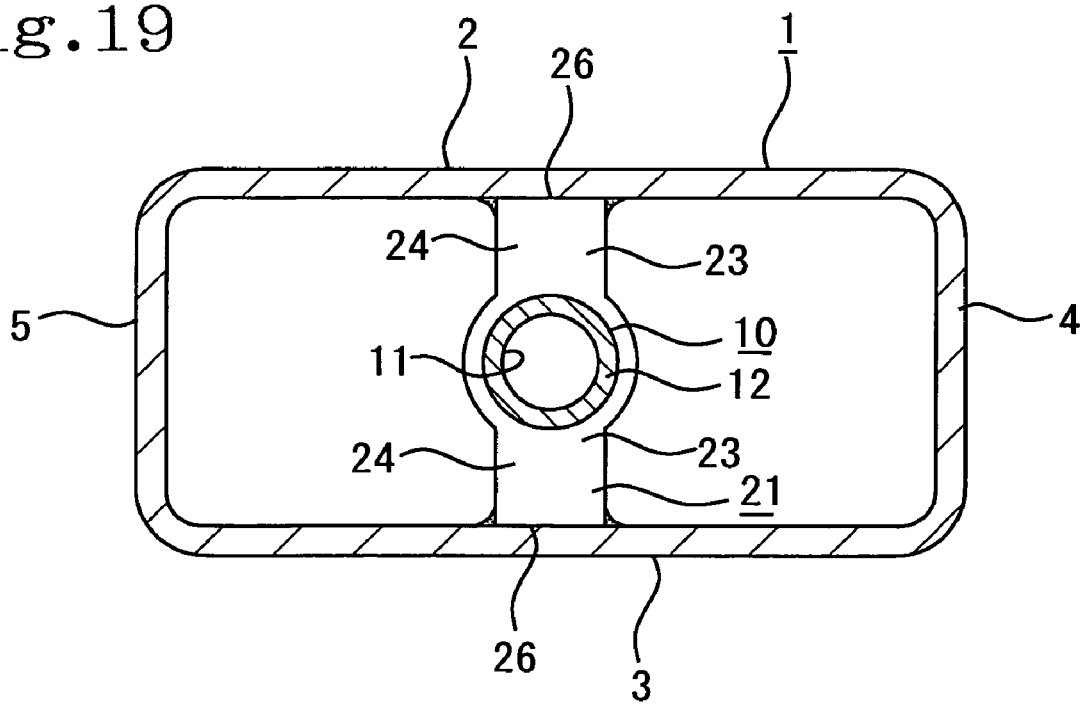
FIG. 19 is a cross sectional view taking along the line D-D of FIG. 18.

The ninth embodiment is explained referring to FIGS. 17 to 19, connection member 21 according to the ninth embodiment as shown in FIG. 17 is composed of cylindrical section 22 of cylindrical shape and L-shaped connection pieces 23 projecting outward from one end of cylindrical section 22 at two positions opposing to each other by 180 degree. As shown in FIG. 18, an inner diameter of cylindrical section 22 is formed slightly larger than an outer diameter of insertion section 12 of fuel introduction pipe 10, such that the inner surface of cylindrical section 22 can be brought into contact with the outer peripheral surface of insertion section 12 when cylindrical section 22 receives therethrough insertion section 12 of fuel introduction pipe 10.

Connection pieces 23 has projections 24 projecting outwardly at one end of cylindrical section 22 such that the projections project in a diameter direction from cylindrical section 22 and folding sections 25 extending from the front ends of projections 24 in an axis direction extend parallel to cylindrical section 22. As shown in FIGS. 18 and 19, forming lengths of projections 24 are adjusted such that folding sections 25 are able to contact with the interior surface of fuel delivery pipe body 1 when fuel introduction pipe 10 is received by connection member 21.

As shown in FIG. 18, the front end of insertion section 12 of fuel introduction pipe 10 is received by cylindrical section 22 of connection member 21 such that the one end of cylindrical section 22 is positioned at a side of opening 11 of fuel introduction pipe 10 and cylindrical section 22 of connection member 21 and fuel introduction pipe 10 are secured each other by means of brazing. Surfaces of folding sections 25 of connecting pieces 23 provided with connecting member 21 at two positions are brought into contact with the interior surface of top wall 2 and the interior surface of bottom wall 3 of fuel delivery pipe body 1, respectively, to thus made contact section 26 is secured by means of brazing.

As such, cylindrical section 22 of connection member 21 is securely connected to fuel introduction pipe 10 and connection pieces 23 are also securely connected to fuel delivery pipe body 1, thereby achieving a secure connection of the front end of insertion section 12 of fuel introduction pipe 10 onto the interior surface of fuel delivery pipe body 1 through connection member 21. With such secure connection, vibration of insertion section 12 of fuel introduction pipe 10 can be suppressed and therefore the breakage of fuel introduction pipe 10 around the securing section with end wall 6 can be prevented.

Figure 20:
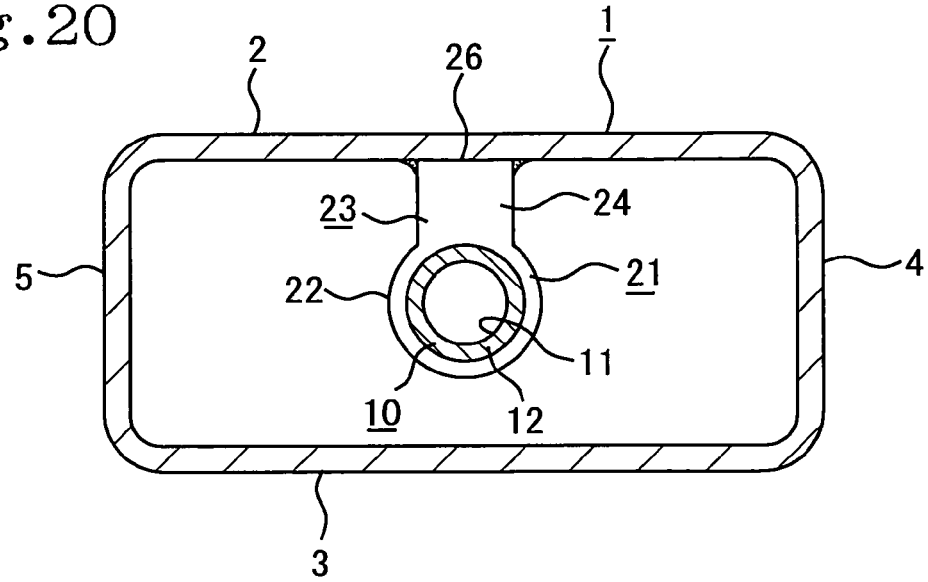
FIG. 20 is a cross sectional view of the fuel delivery pipe illustrating the tenth embodiment according to the first to fourth inventions of the present application.

In the ninth embodiment as shown in FIGS. 18 and 19, connecting member 21 is provided with connecting pieces 23 at two positions thereof, each of which is secured to the interior surface of top wall 2 and the interior surface of bottom wall 3 of fuel delivery pipe body 1, respectively, whereas in the other embodiment such as a tenth embodiment shown in FIG. 20, connecting member 21 is provided with connecting piece 23 only at one position thereof. The connecting piece is capable of being secured to the interior surface of top wall 2 of fuel delivery pipe body 1. By providing connecting piece 23 at only one position, a structure of connecting member 21 becomes simple, resulting in achieving an easy manufacturing of connecting member 21 and an easy connection of connecting piece 23 of connecting member 21 with the interior surface of fuel delivery pipe body 1. In this case, however, a stability of connection between fuel introduction pipe 10 and fuel delivery pipe body 1 will be relatively degraded comparing to that of the ninth embodiment. In the tenth embodiment as stated above, connecting piece 23 is secured to the interior surface of top wall 2 of fuel delivery pipe body 1, whereas in the other embodiments, connecting piece 23 can be secured to the interior surface of bottom wall 3 of fuel delivery pipe body 1.

Figure 21:
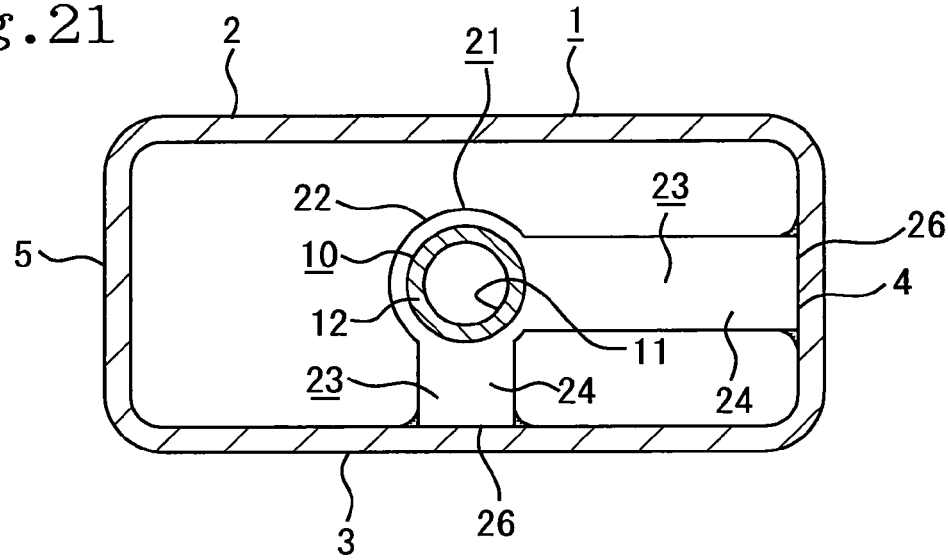
FIG. 21 is a cross sectional view of the fuel delivery pipe illustrating the eleventh embodiment according to the first to fourth inventions of the present application.

As shown in FIG. 21, connecting member 21 may be provided with connecting pieces 23 at two positions such that the connecting pieces cross at right angles, i.e., one of the connecting pieces extends in a horizontal direction and the other extends in a vertical direction. Then, connecting pieces 23 can be secured to side wall 4 and bottom wall 3 of fuel delivery pipe body 1, respectively.

Figure 22:
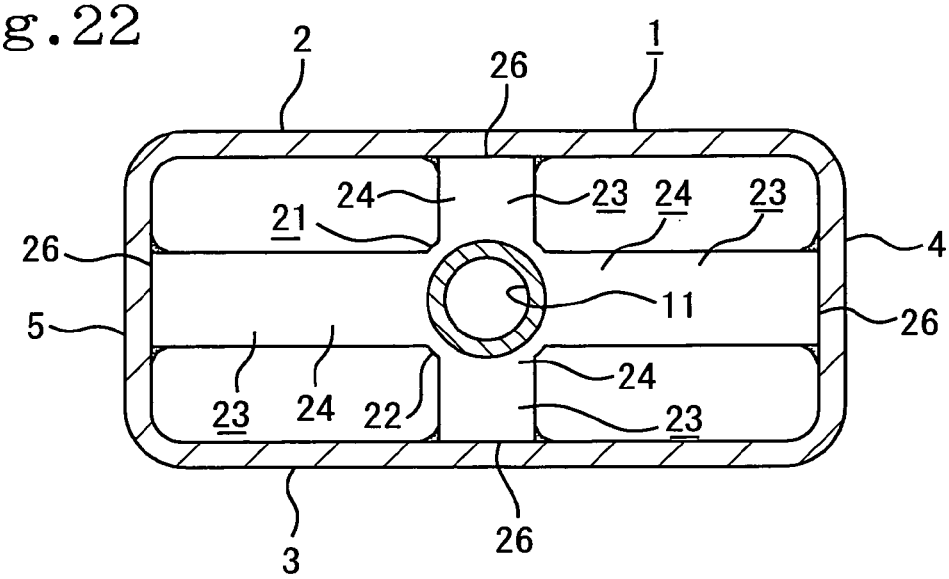
FIG. 22 is a cross sectional view of the fuel delivery pipe illustrating the twelfth embodiment according to the first to fourth inventions of the present application.

As shown in FIG. 22, connecting member 21 may be provided with connecting pieces 23 at four positions at each 90 degree and connecting pieces 23 can be secured to the interior surface of top wall 2, the interior surface of bottom wall 3 and the interior surfaces of side walls 4, 5 of fuel delivery pipe body 1, respectively. By providing connecting pieces 23 at four positions, securing of inserting section 12 of fuel introduction pipe 10 within fuel delivery pipe body 1 can be made tighter and therefore the vibration suppressing effect of insertion section 12 of fuel introduction pipe 10 can be further enhanced.

Figure 23:
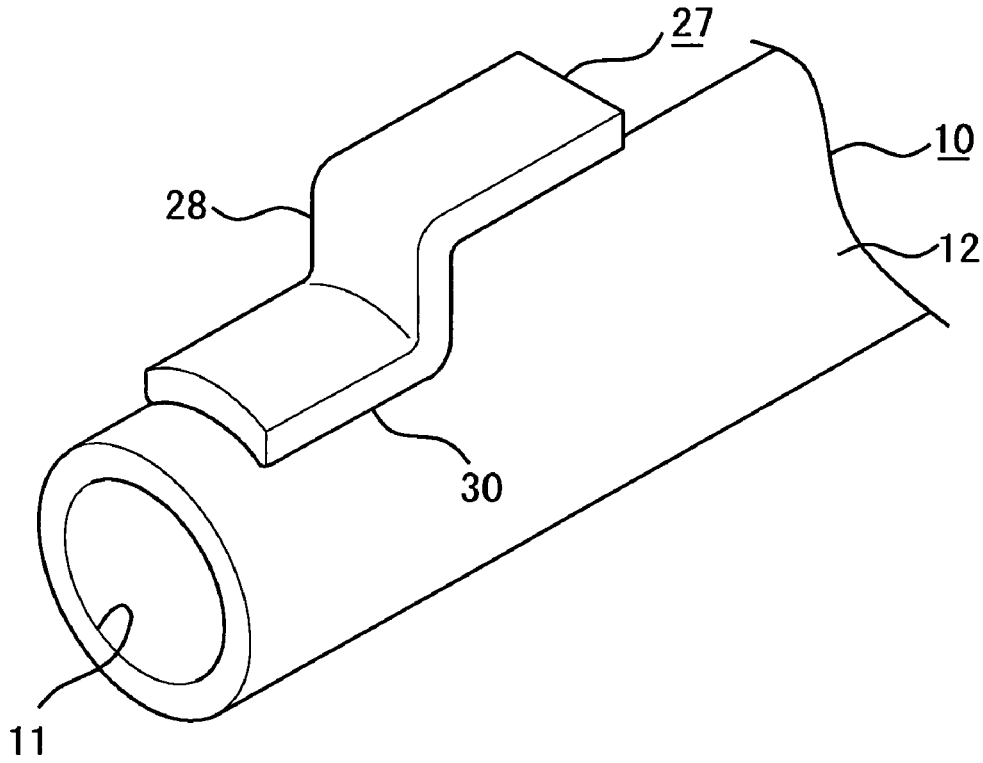
FIG. 23 is a perspective view illustrating a state that the connecting member is assembled with the fuel introduction pipe of the thirteenth embodiment according to the first to fourth inventions of the present application.

In the above ninth to twelfth embodiments, connecting member 21 is composed of cylindrical section 22 and connecting pieces 23, whereas in a thirteenth embodiment, used is connecting member 27 formed such that a rectangular flat plate is bent into crank shape. The thirteenth embodiment is explained referring to FIGS. 23 and 24. Connecting member 27 according to the thirteenth embodiment is bent into the vertical direction with a certain space from the one end as shown in FIG. 23 and other end of thus formed bent section 28 is further bent into a vertical direction with regard to bent section 28 with a certain space.

Figure 24:
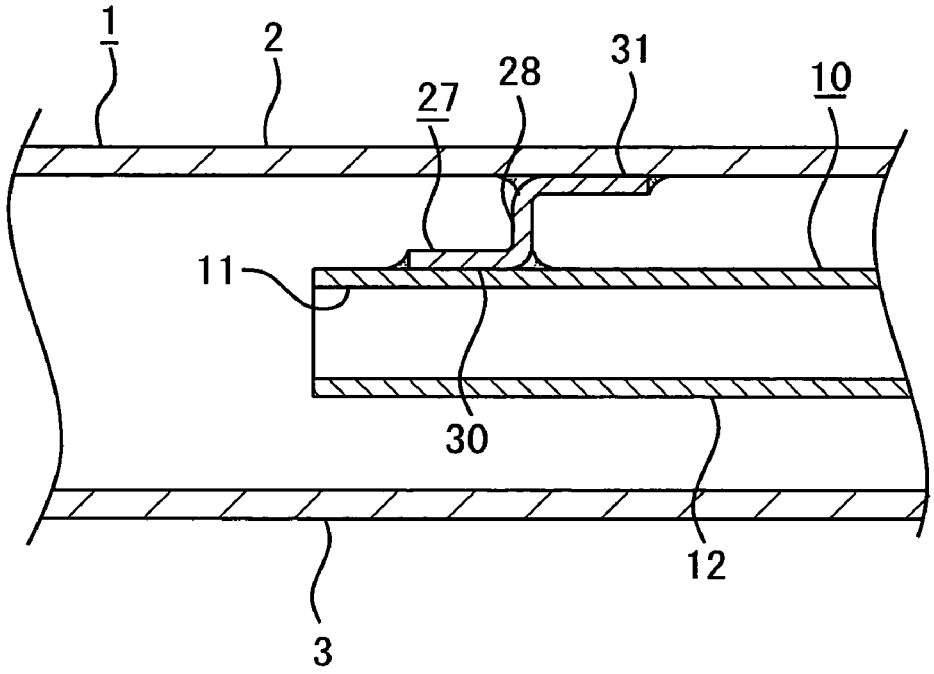
FIG. 24 is a cross sectional view of the fuel delivery pipe according to the thirteenth embodiment.

As shown in FIG. 24, bottom surface 30 of one end of connecting member 27 is securely connected by means of brazing at the front end of insertion section 12 of fuel introduction pipe 10 and upper surface 31 of the other end is also secured by means of brazing to the interior surface of top wall 2 of fuel delivery pipe body 1. With such secure connection of connecting member 27 to the front end of insertion section 12 of fuel introduction pipe 10 and the interior surface of fuel delivery pipe body 1 allows insertion section 12 of fuel introduction pipe 10 to be secured to the interior surface of fuel delivery pipe body 1 through connecting member 27. In the thirteenth embodiment as stated above, connecting member 27 is secured to the interior surface of top wall 2 of fuel delivery pipe body 1, whereas in the other embodiments, connecting member 27 may be secured to the interior surface of bottom wall 3 of fuel delivery body 1.

Figure 25:
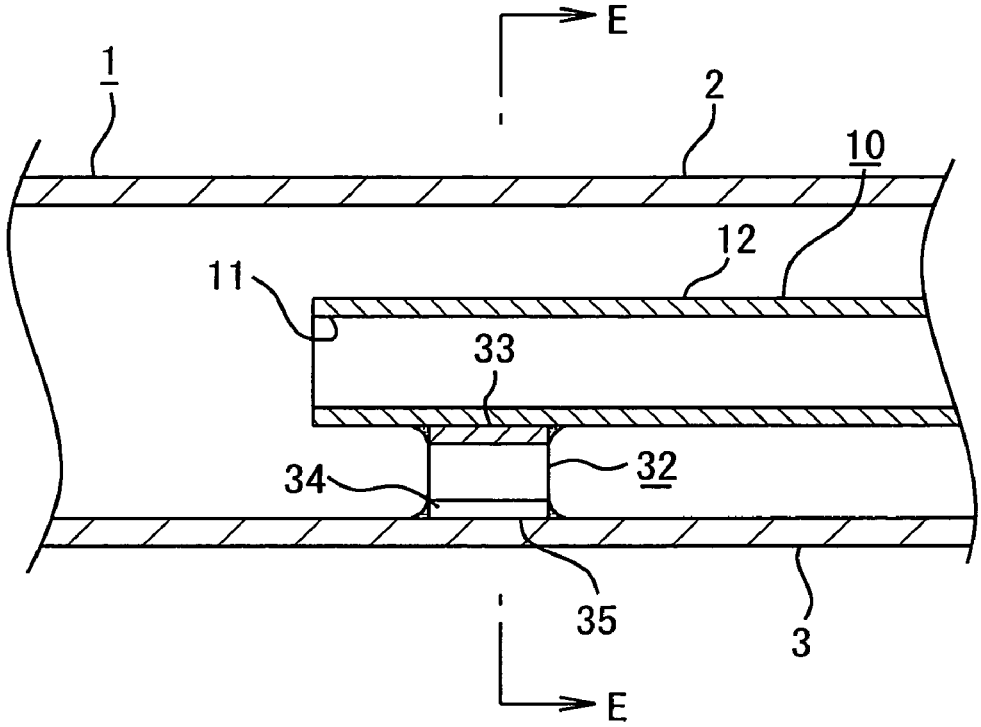
FIG. 25 is a cross sectional view of the fuel delivery pipe illustrating the fourteenth embodiment according to the first to fourth inventions of the present application.
Figure 26:
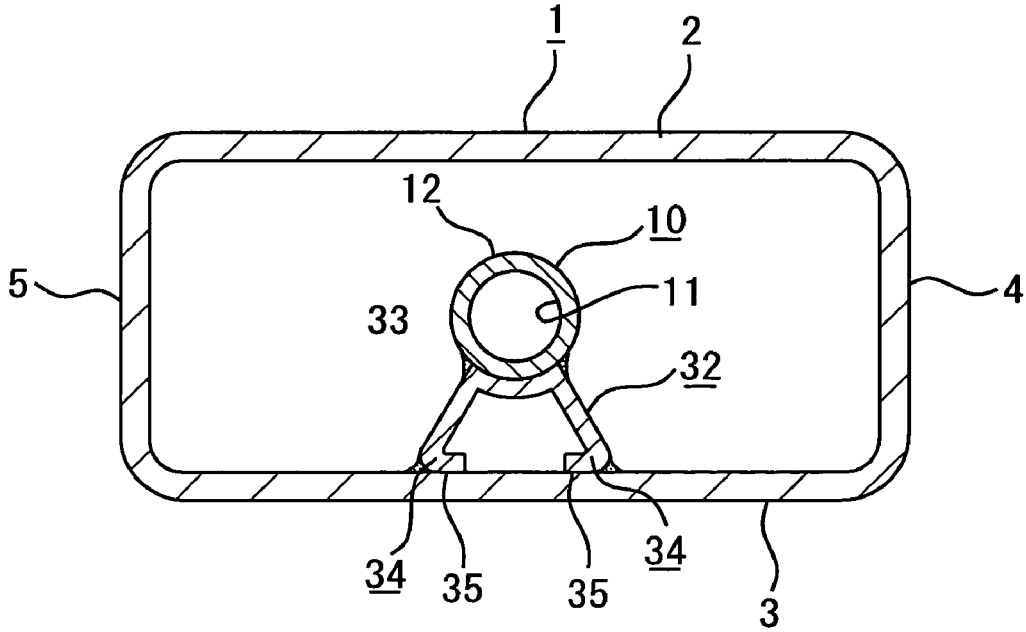
FIG. 26 is a cross sectional view taking along the line E-E of FIG. 25.

A fourteenth embodiment is explained referring to FIGS. 25 and 26. A flat plate is bent into generally trapezoid in cross section to form connecting member 32 as shown in FIG. 26, upper surface 33 of connecting member 32 is formed into an arc-shaped concave such that the outer peripheral surface of fuel introduction pipe 10 closely contact with the upper surface and both of the lower ends of connecting member 32 are bent inwardly to form lower end collars 34. Then, as shown in FIGS. 25 and 26, contact section 35 between lower end collars 34 and the interior surface of bottom wall 3 of fuel delivery pipe body 1 is secured by means of brazing, on upper surface 33 of connecting member 32 is mounted insertion section 12 of fuel introduction pipe 10 and then insertion section 12 and upper surface 33 are secured each other by brazing.

Alike the fourteenth embodiment and the thirteenth embodiment, one end and the other end of each connecting member 27, 32 is securely connected to insertion section 12 of fuel introduction pipe 10 and the interior surface of fuel delivery pipe body 1, thereby achieving securing of the front end of insertion section 12 of fuel introduction pipe 10 to the interior surface of fuel delivery pipe body 1, resulting in achieving a suppression of vibration of the front end of insertion section 12 of fuel introduction pipe 10. Since connecting members 27, 32 according to the fourteenth embodiment and the thirteenth embodiment are simple, manufacturing, assembling and the like of connecting members 27, 32 become easy and inexpensive products can be realized.

Figure 27:
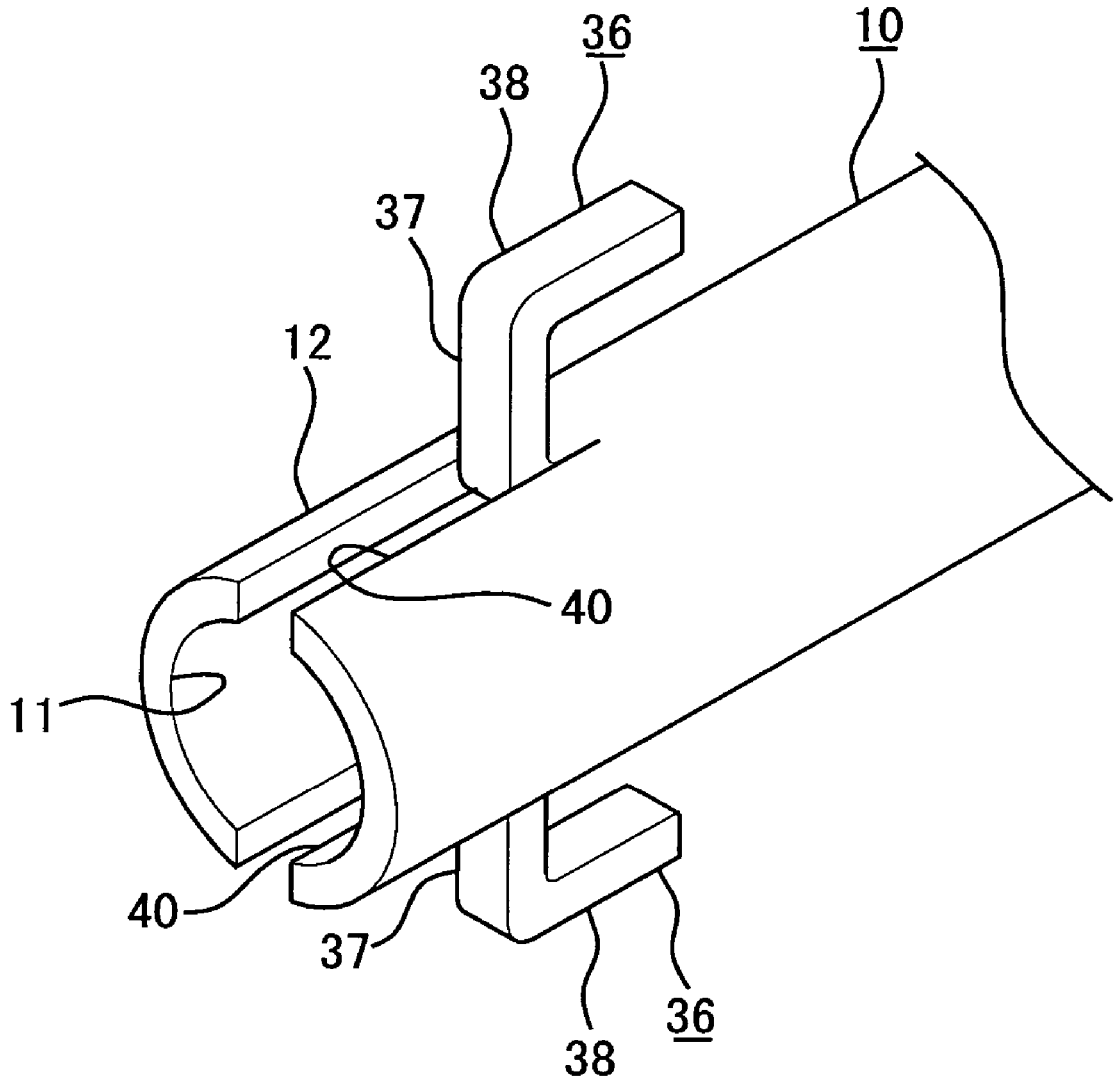
FIG. 27 is a perspective view of the fuel introduction pipe of the fifteenth embodiment according to the first to fourth inventions of the present application.

In the above ninth to fourteenth embodiments, fuel introduction pipe 10 is secured to the interior surface of fuel delivery pipe body 1 through connecting members 21, 27, 32 provided independently from fuel introduction pipe 10, whereas in a fifteenth embodiment, fuel introduction pipe 10 is provided with bent section 36 in one piece, and bent section 36 is secured to the interior surface of fuel delivery pipe body 1. The fifteenth embodiment is explained referring to FIGS. 27 to 29. The front end of fuel introduction pipe 10 is provided with a pair of cutting portions parallel to the axis direction, the proximal ends of the cutting portions are bent outwardly in the vertical direction as shown in FIG. 27 and the front ends of cutting portions 36 are folded vertically in an opposite direction of the front end of fuel introduction pipe 10.

Figure 28:
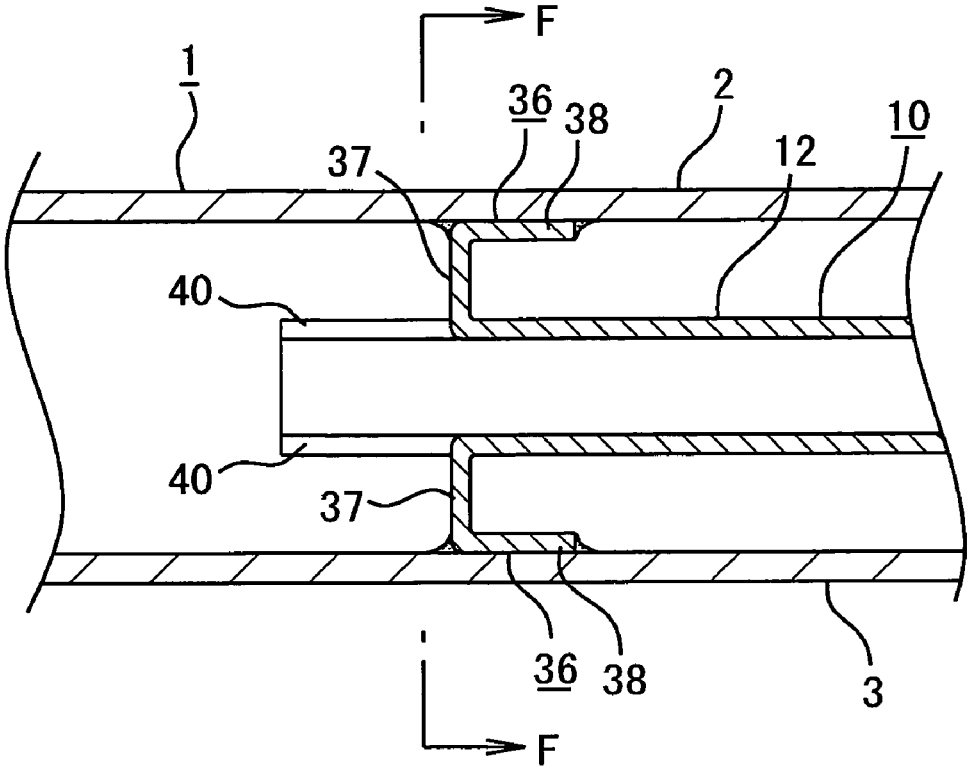
FIG. 28 is a cross sectional view of the fuel delivery pipe of the fifteenth embodiment.
Figure 29:
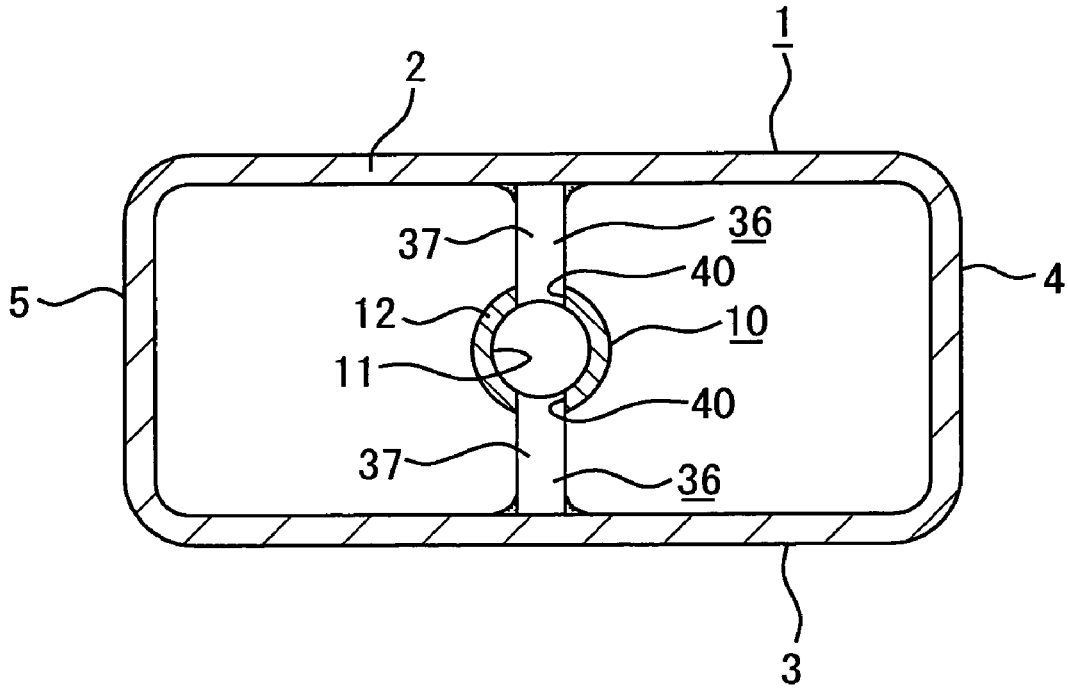
FIG. 29 is a cross sectional view taking along the line F-F of FIG. 28.

A forming length of proximal ends 37 of folded portions 36 formed in the vertical direction with regard to fuel introduction pipe 10 is adjusted such that front ends 38 folded over in the vertical direction with regard to proximal ends 37 of folded sections 36 can contact the interior surface of fuel delivery pipe body 1 when fuel introduction pipe 10 is inserted within fuel delivery pipe body 1. Then, as shown in FIGS. 28 and 29, fuel introduction pipe 10 is inserted into fuel delivery pipe body 1 and front ends 38 of bent sections 36 of fuel introduction pipe 10 are secured to the interior surface of fuel delivery pipe body 1 by means of brazing.

With such an assembling as state above, the front ends of insertion section 12 of fuel introduction pipe 10 can be secured to the interior surface of fuel delivery pipe body 1, thereby being capable of suppressing the vibration of the front end of insertion section 12 of fuel introduction pipe 10. Since, only with a formation of bent sections 36 by making cutting portions in fuel introduction pipe 10, fuel introduction pipe 10 can be secured to fuel delivery pipe body 1, no additional parts are required but products which are simple and inexpensive in manufacturing can be obtained.

As described above, it is obvious that this invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fuel delivery pipe, comprising:

a fuel delivery pipe body of a returnless type without a circuit returning to a fuel tank, said fuel delivery pipe body having an entire length extending between first and second end walls;

a fuel introduction pipe coupled to the fuel tank through an underfloor pipe arrangement, said fuel introduction pipe being inserted into an interior of the fuel delivery pipe body such that an end thereof is located a distance of between 15% and 35% of said entire length from either of said first and second end walls and securely connected to the fuel delivery pipe body, said fuel introduction pipe having an opening within said fuel delivery pipe body only at said end;

a flexible absorb wall surface formed on a wall surface of said fuel delivery pipe body; and holders into which injection nozzles are insertable.

2. A fuel delivery pipe according to claim 1, wherein the fuel introduction pipe is inserted into the interior of the fuel delivery pipe body to a position in which said fuel introduction pipe extends between 15% and 35% of the entire length of said fuel delivery pipe body and is securely connected to the fuel delivery pipe body.

3. A fuel delivery pipe according to claim 1, wherein the fuel introduction pipe is inserted into the interior of the fuel delivery pipe body such that an end of said fuel introduction pipe is located a distance of between 20% and 30% of the entire length of said fuel delivery pipe body from either of said first and second end walls and is securely connected to the fuel delivery pipe body.

4. The fuel delivery pipe as claimed in claim 2 or 3, wherein the fuel introduction pipe is secured at an end wall of the fuel delivery pipe body.

5. The fuel delivery pipe as claimed in claim 4, wherein an outer peripheral surface of an insertion section inserted and arranged within the fuel delivery pipe body is directly secured to the interior surface of the fuel delivery pipe body.

6. The fuel delivery pipe as claimed in claim 5, wherein the outer peripheral surface of the front end of the fuel introduction pipe is directly secured to the interior of the fuel delivery pipe body such that an insertion section of the fuel introduction pipe inserted and arranged within the fuel delivery pipe body is provided with a curved portion, and a front end of the curved portion is secured to the interior surface of the fuel delivery pipe body.

7. The fuel delivery pipe as claimed in claim 5, wherein the outer peripheral surface of the front end of the fuel introduction pipe is directly secured to the interior of the fuel delivery pipe body such that a diameter of the front end of the insertion section of the fuel introduction pipe inserted and arranged within the fuel delivery pipe body is expanded, and an outer peripheral surface of the expanded diameter section is secured to the interior surface of the fuel delivery pipe body.

8. The fuel delivery pipe as claimed in claim 5, wherein the outer peripheral surface of the front end of the fuel introduction pipe is directly secured to the interior of the fuel delivery pipe body such that the front end of the insertion section of the fuel introduction pipe inserted and arranged within the fuel delivery pipe body is formed with an projection which projects in a direction of the interior surface of the fuel delivery pipe body, and an outer peripheral surface of the projection is secured to the interior surface of the fuel delivery pipe body.

9. The fuel delivery pipe as claimed in claim 4, wherein the fuel introduction pipe is provided with a connecting member around the outer peripheral surface of the front end of the insertion section inserted and arranged within the fuel delivery pipe body and secured to the interior surface of the fuel delivery pipe body through the connecting member.

10. The fuel delivery pipe as claimed in claim 4, wherein the fuel introduction pipe is provided with a pair of cut portions at least at one position on the front end thereof in an axis direction, the cut portions are bent toward the fuel delivery pipe body, and thus bent sections are secured to the interior surface of the fuel delivery pipe body.

* * * * *